US007029314B2

(12) United States Patent
Muro et al.

(10) Patent No.: US 7,029,314 B2
(45) Date of Patent: Apr. 18, 2006

(54) PRESS-CONTACTING CONNECTOR

(75) Inventors: Takashi Muro, Haibara-gun (JP); Kaoru Matsumura, Haibara-gun (JP); Nobuyuki Sakamoto, Haibara-gun (JP); Toshiharu Kawashima, Haibara-gun (JP); Makoto Yamanashi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/835,567

(22) Filed: Apr. 30, 2004

(65) Prior Publication Data

US 2004/0266250 A1 Dec. 30, 2004

(30) Foreign Application Priority Data

May 6, 2003 (JP) ..... P.2003-128050

(51) Int. Cl.
*H01R 39/00* (2006.01)

(52) U.S. Cl. ..... 439/404

(58) Field of Classification Search ..... 439/395, 439/396, 404, 397, 399, 417
See application file for complete search history.

(56) References Cited

U.S. PATENT DOCUMENTS

| | | | |
|---|---|---|---|
| 4,460,228 | A | 7/1984 | Lane et al. |
| 4,932,892 | A | 6/1990 | Hatch |
| 6,280,242 | B1 | 8/2001 | Jochen et al. |

FOREIGN PATENT DOCUMENTS

| | | | |
|---|---|---|---|
| JP | 1-68659 | U | 5/1989 |
| JP | 8-124612 | A | 5/1996 |
| NL | 7 410 966 | A | 2/1976 |

*Primary Examiner*—Briggitte R. Hammond
(74) *Attorney, Agent, or Firm*—Sughrue Mion, PLLC

(57) ABSTRACT

A press-contacting connector includes a connector housing, a wire holder and an assisting plate. The connector housing has a plurality of press-contacting terminals and a holder fitting portion in which a plurality of press-contacting blades of the press-contacting terminals are provided. The wire holder is fitted into the holder fitting portion of the connector housing, and holding a plurality of wires. The assisting plate is attached to the wire holder so as to press-hold press-contacting portions of the wires to the wire holder. The assisting plate has a plurality of guide portions which guides the press-contacting blades to the press-contacting portions of the wires respectively. When the wire holder is fitted into the connector housing, the press-contacting blades press-contact the press-contacting portions of the wires respectively.

7 Claims, 26 Drawing Sheets

PRESS-CONTACTING CONNECTOR

BACKGROUND OF THE INVENTION

This invention relates to a press-contacting connector, and more particularly to a press-contacting connector in which a wire holder, holding a plurality of wires, is fitted into a connector housing which receives and holds a plurality of press-contacting terminals, thereby collectively press-contacting the wires with the press-contacting terminals, respectively.

In order to enhance the efficiency of a press-contacting operation of a press-contacting connector, there have heretofore been proposed various press-contacting connectors in which a wire holder, holding a plurality of wires, is fitted into a connector housing, receiving and holding a plurality of press-contacting terminals, thereby collectively press-contacting the wires with the press-contacting terminals, respectively (see, for example, JP-UM-A-1-68659 and JP-A-8-124612).

For example, a press-contacting connector 1, shown in FIGS. 29 to 31, is designed such that a plurality of wires 3 are press-connected to a press-contacting type joint terminal 6 having a plurality of press-contacting blades 5 formed integrally therewith. This connector 1 includes a connector housing 8 for receiving and holding the press-contacting type joint terminal 6, and a wire holder 9 for holding the plurality of wires 3 at the same pitch as a pitch at which the press-contacting blades 5 of the press-contacting type joint terminal 6 are arranged.

As shown in FIGS. 29 and 30, the connector housing 8 has a holder fitting portion 8*a* into which the press-contacting blades 5 of the press-contacting type joint terminal 6, received and held in this connector housing 8, project. The wire holder 9 has wire holding grooves 9*a* for respectively holding the wires 3 at the same pitch as the arrangement pitch of the press-contacting blades 5, and each wire holding groove 9*a* has press-contacting blade escape grooves 9*b* into which the corresponding press-contacting blade 5 enter when the wire holder is fitted into the holder fitting portion 8*a*.

Therefore, in this press-contacting connector 1, the plurality of wires 3 can be collectively press-contacted respectively with the press-contacting blades 5 by fitting the wire holder 9 into the holder fitting portion 8*a* of the connector housing 8.

A considerable operating force is required for collectively press-contacting the plurality of press-contacting blades 5 (held in the connector housing 8) respectively with the plurality of wires 3, held by the wire holder 9. Also, the connector housing 8 and the wire holder 9 which are to be fitted together need to be pressed toward each other accurately in the fitting direction so that twisting will not occur between the connector housing 8 and the wire holder 9.

Therefore, when the wire holder 9 is fitted into the connector housing 8, the two are moved to be put on a special-purpose pressing tool, and a strong pressing operation is effected by the special-purpose tool at a stroke, thereby achieve the fitted condition in which the press-contacting blades 5 cut sheaths of the wires 3, respectively, and are press-contacted with wire conductors, respectively as shown in FIG. 31.

In this fitted condition, as shown in FIG. 2, engagement projections 9*c*, formed on the wire holder 9, are engaged respectively in retaining grooves 8*b* formed in the connector housing 8, thereby locking this fitted condition.

However, the plurality of press-contacting blades 5, held in the connector housing 8, are thin, and besides a length L of projecting of each press-contacting blade 5 from a receiving/holding portion 8*c* of the connector housing 8 is long as shown in FIG. 30.

Therefore, when the strong pressing operation necessary for the collective press-contacting of the wires 3 was effected, there is a fear that a large bending load acted on the distal end of the press-contacting blade 5 because of slight lifting of the corresponding wire 3 (due to a mounting error), a slight inclination of the press-contacting blade 5 or others, so that this press-contacting blade 5 is buckled and deformed, thus causing the incomplete press-contact.

SUMMARY OF THE INVENTION

It is therefore an object of this invention to overcome the above problem, and more specifically to provide a good press-contacting connector in which when fitting a wire holder into a connector housing, the buckling or the like of press-contacting blades, inviting incomplete press-contact, is positively prevented, and the press-contacting of a plurality of wires can be stably effected in a collective manner.

In order to achieve the above object, according to the present invention, there is provided a press-contacting connector, comprising:

a connector housing, including:

a plurality of press-contacting terminals; and a holder fitting portion, in which a plurality of press-contacting blades of the press-contacting terminals are provided;

a wire holder, fitted into the holder fitting portion of the connector housing, and holding a plurality of wires; and an assisting plate, attached to the wire holder so as to press press-contacting portions of the wires, and the assisting plate having a plurality of guide portions which guides the press-contacting blades to the press-contacting portions of the wires respectively, wherein when the wire holder is fitted into the connector housing, the press-contacting blades press-contact the press-contacting portions of the wires respectively.

Preferably, the wire holder holds the wires at a pitch corresponding to a pitch at which the press-contacting blades are arranged in the holder fitting portion.

In the press-contacting connector of the above construction, when the assisting plate is attached to the wire holder, the press-contacting portions of the plurality of wires, held by the wire holder, are press-held between the wire holder and the assisting plate. Therefore, until the wire holder is completely fitted into the holder fitting portion of the connector housing, the press-contacting portions of the wires, held by the wire holder, are positively prevented from displacement such as lifting.

Preferably, the guide portions receive distal ends of the press-contacting blades respectively, when the wire holder is provisionally fitted into the holder fitting portion. The guide portions guide the press-contacting blades respectively to the press-contacting portions of the wires when the wire holder is completely fitted into the holder fitting portion.

In the press-contacting connector of the above construction, when the wire holder, having the assisting plate fittingly attached thereto, is provisionally fitted into the holder fitting portion of the connector housing, the distal ends of the press-contacting blades of the press-contacting terminals, received and held in the connector housing, are received respectively in the press-contacting blade guide portions of the assisting plate, and therefore the distal end of each press-contacting blade is supported in a proper position by the press-contacting blade guide portion.

Therefore, when a pressing operation is effected for shifting the wire holder from the provisionally-fitted condition to the completely-fitted condition relative to the connector housing, the deflection, buckling, etc., of the press-contacting blades, inviting the incomplete press-contact, can be positively prevented, and the plurality of wires can be collectively press-contacted respectively with the press-contacting terminals in a stable manner.

Therefore, there can be provided the good press-contacting connector in which when fitting the wire holder into the connector housing, the buckling or the like of press-contacting blades, invite the incomplete press-contact, is positively prevented, and the press-contacting of the plurality of wires can be stably effected in a collective manner.

Preferably, the wire holder includes a plurality of wire-holding grooves which respectively position the press-contacting portions of the wires in parallel and wire end-holding portions which are formed respectively at both ends of the wire-holding grooves. The wire end-holding portions hold the press-contacting portions of the wires respectively so as to bent at both ends of the press-contacting portions.

The wire end-holding portions are wire end-holding hole which is formed respectively at least one end of the wire-holding grooves so as to hold end portions of the wires respectively.

The wire end-holding portions are holding grooves which are formed on a side face of the wire holder, and which communicate respectively with at least one end of the wire-holding grooves so as to hold extending portions of the wires.

In the press-contacting connector of the above construction, each of the wires, held by the wire holder, is kept bent at an angle of about 90 degrees at the both ends of its press-contacting portion, and these wire bent portions, formed respectively at the both ends of the press-contacting portion, function as tension-proof portions for withstanding a tension acting on the wire.

And besides, the end portion of each wire, disposed near to the press-contacting portion thereof, is inserted and held in the wire end-holding portion, and therefore it is not necessary to effect an end portion-processing operation for preventing leakage at the end portion of each wire, so that the efficiency of the operation is enhanced.

Preferably, the press-contacting connector includes a provisionally-retaining member which retains the wire holder to the holder fitting portion in a provisionally-fitted condition. The provisionally-retaining member is provided between the connector housing and the wire holder.

In the press-contacting connector of the above construction, the wire holder is provisionally fitted in the connector housing, and in this condition the two are moved to be put on a connector fitting jig or the like, and the two are completely fitted together, thereby collectively press-contacting the plurality of wires with the press-contacting blades, respectively. At this time, the wire holder is prevented from being disengaged from the connector housing during the movement.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of a press-contacting connector of the present invention will now be described in detail with reference to the accompanying drawings.

Figure 1:
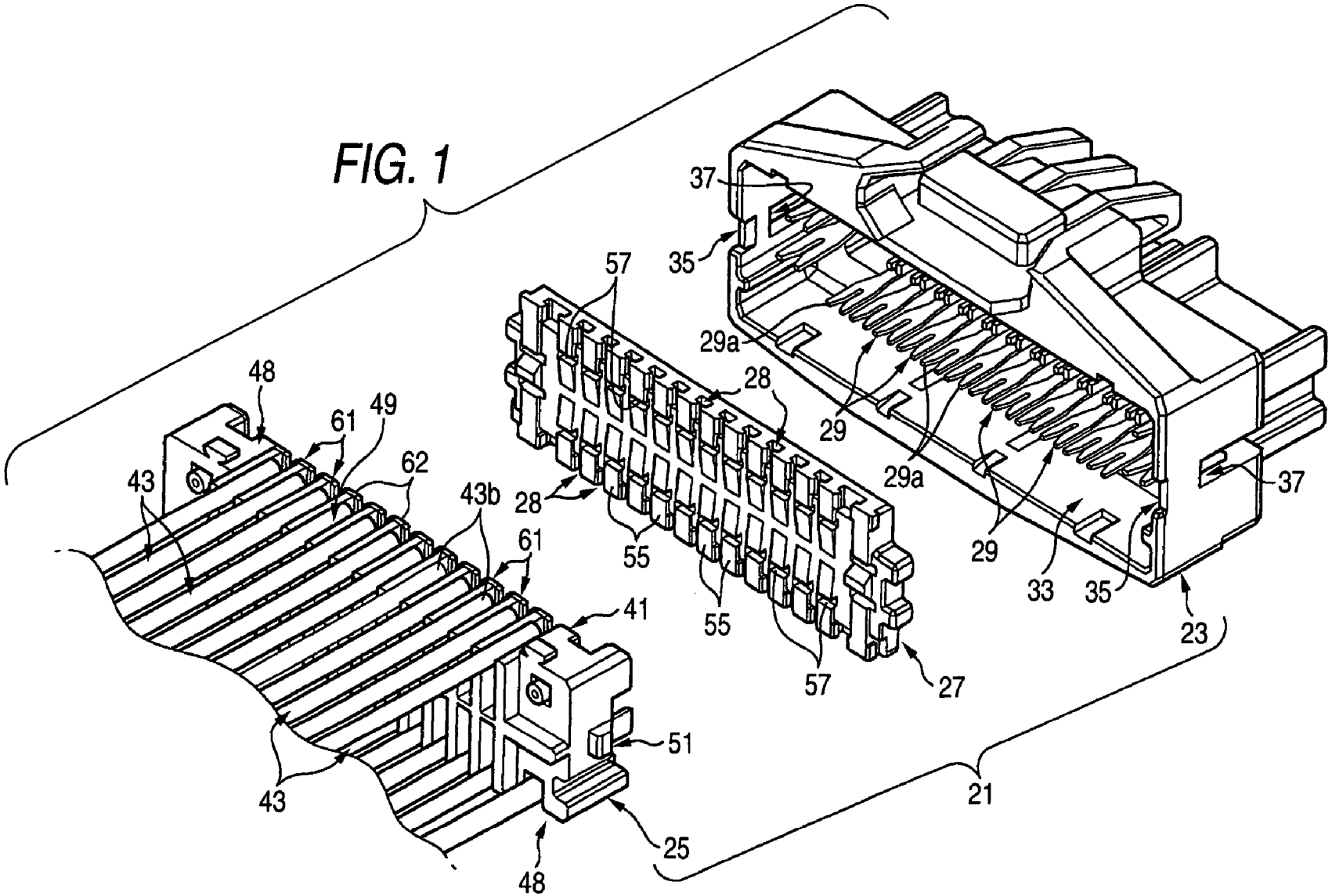
FIG. 1 is an exploded, perspective view of a press-contacting connector according to a first embodiment of the present invention.

As shown in FIG. 1, the press-contacting connector 21 according to the first embodiment of the invention includes a connector housing 23, a wire holder 25 and a press-contact assisting plate 27.

The connector housing 23 receives and holds a plurality of press-contacting terminals 29 therein, and has a holder fitting portion 33 into which a plurality of press-contacting blades 29*a* of the press-contacting terminals 29, received and held in this connector housing, project. The press-contacting terminals 29 are fitted respectively in terminal receiving holes 31 (see FIGS. 13 and 14) formed through the connector housing in a direction of fitting of this connector into a mating connector.

Provisionally-retaining members 35 as well as completely-retaining members 37 are provided at longitudinal end walls of the holder fitting portion 33. When the wire holder 25 is fitted into the holder fitting portion 33, the provisionally-retaining members 35 hold the wire holder 25 in a provisionally-fitted condition (described later), and when the wire holder 25 is further pushed into the holder fitting portion 33 to be brought into a completely-fitted condition from the provisionally-fitted condition, the completely-retaining members 37 hold and fix the wire holder 25. The provisionally-retaining members 35 and the completely-retaining members 37 will be hereafter described in more detail.

Figure 13:
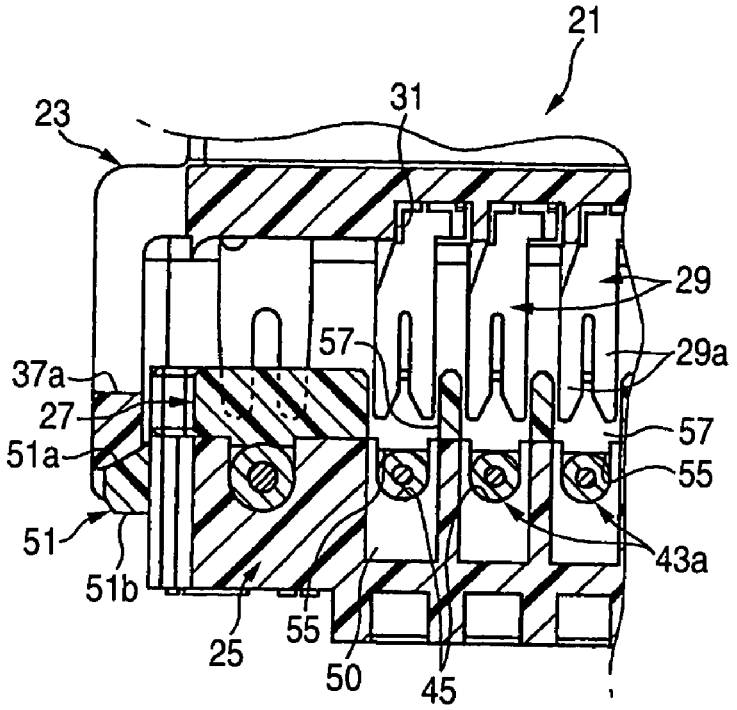
FIG. 13 is a fragmentary, longitudinal cross-sectional view showing a condition in which the wire holder and connector housing, shown in FIG. 11, are provisionally fitted together.
Figure 14:
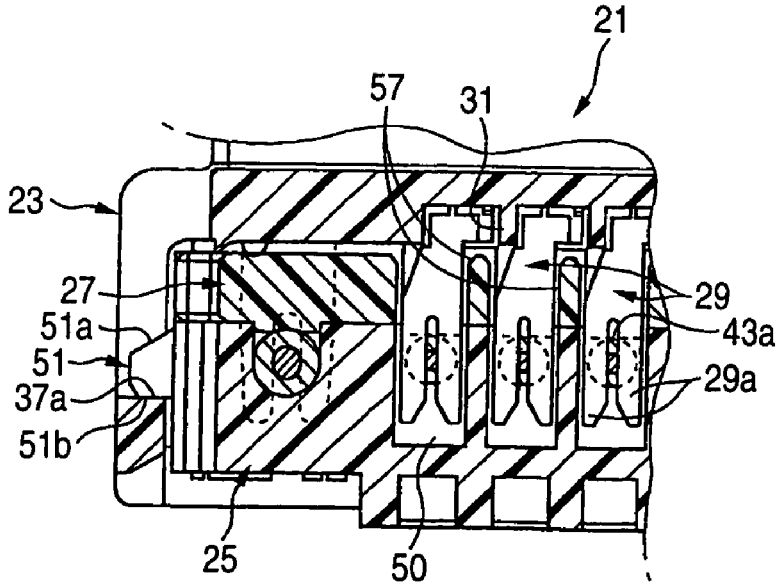
FIG. 14 is a fragmentary, longitudinal cross-sectional view showing a condition in which the wire holder and connector housing, shown in FIG. 11, are completely fitted together.

In this first embodiment, each of the press-contacting terminals 29 to be mounted in the connector housing 23 has the press-contacting blade 29*a* (including a pair of blade portions) formed at one end thereof (as shown in FIG. 13) so as to cut a sheath of a sheathed wire 43 to be press-contacted with a conductor within this sheathed wire. A terminal fitting portion (not shown) for fitting connection to a connection terminal in a mating connector housing is formed at the other end of the press-contacting terminal 29.

Figure 3:
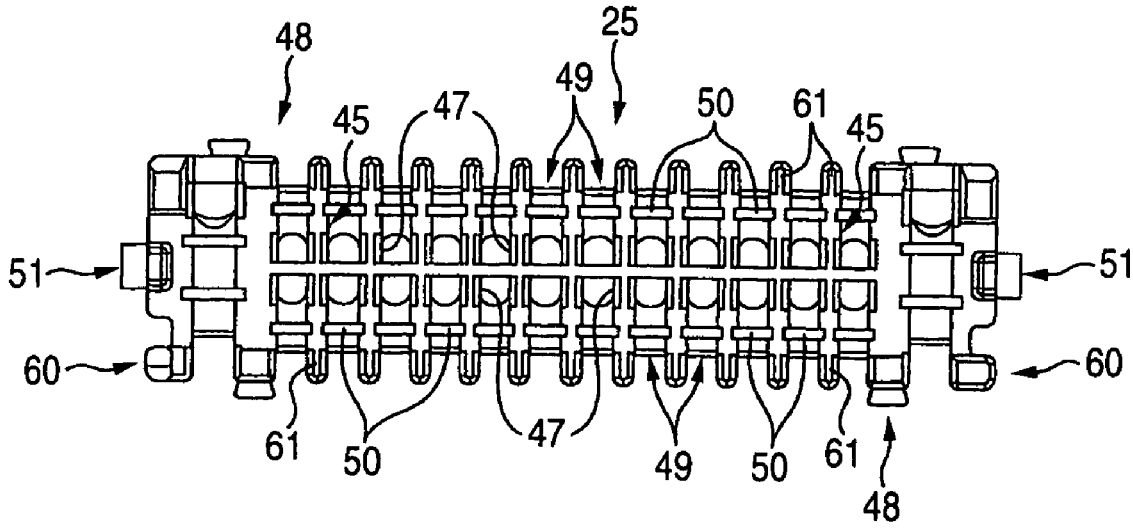
FIG. 3 is a front-elevational view of a wire holder shown in FIG. 1.
Figure 4:
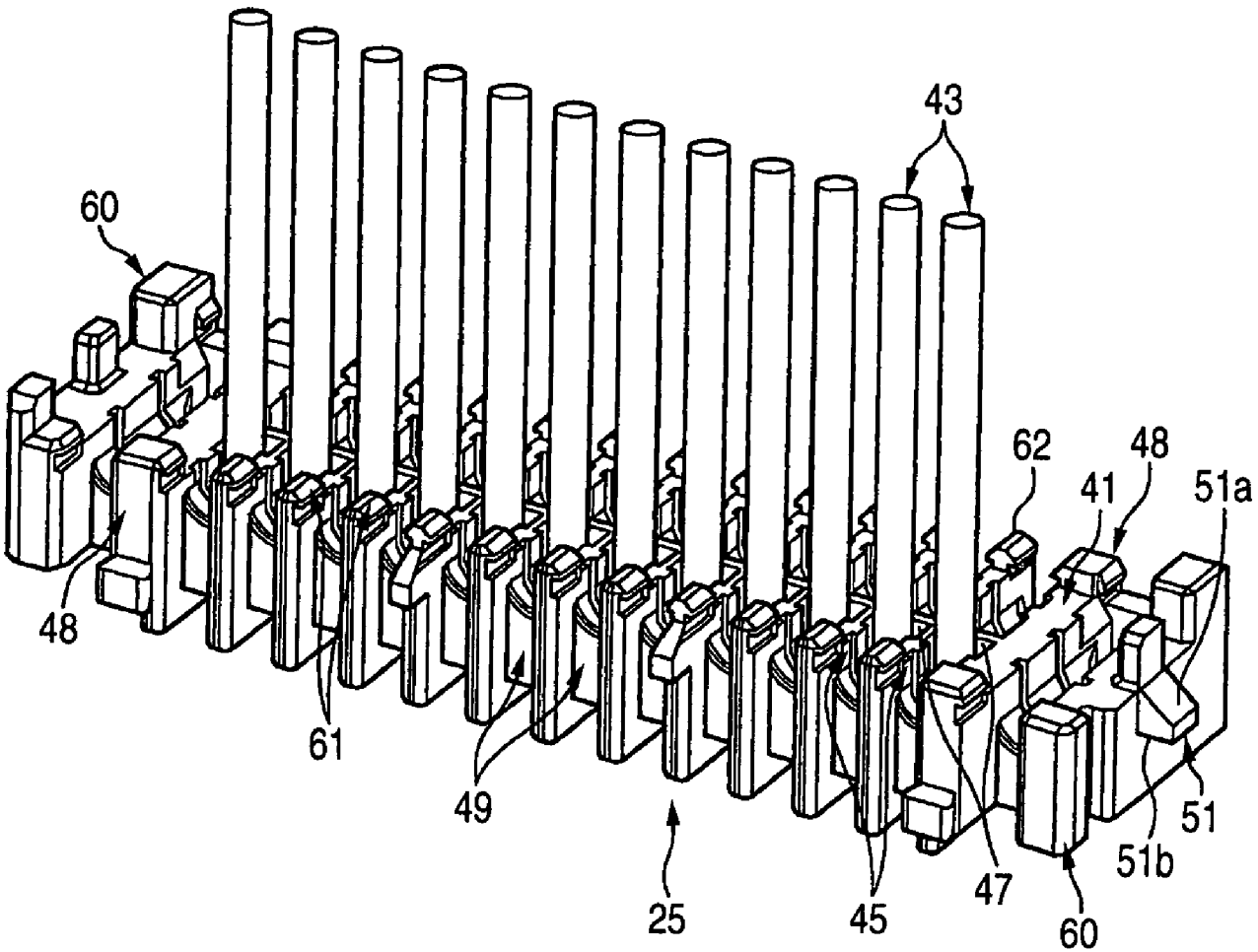
FIG. 4 is a perspective view showing a condition in which end portions of wires are inserted respectively in wire end-holding holes in the wire holder of FIG. 1.
Figure 5:
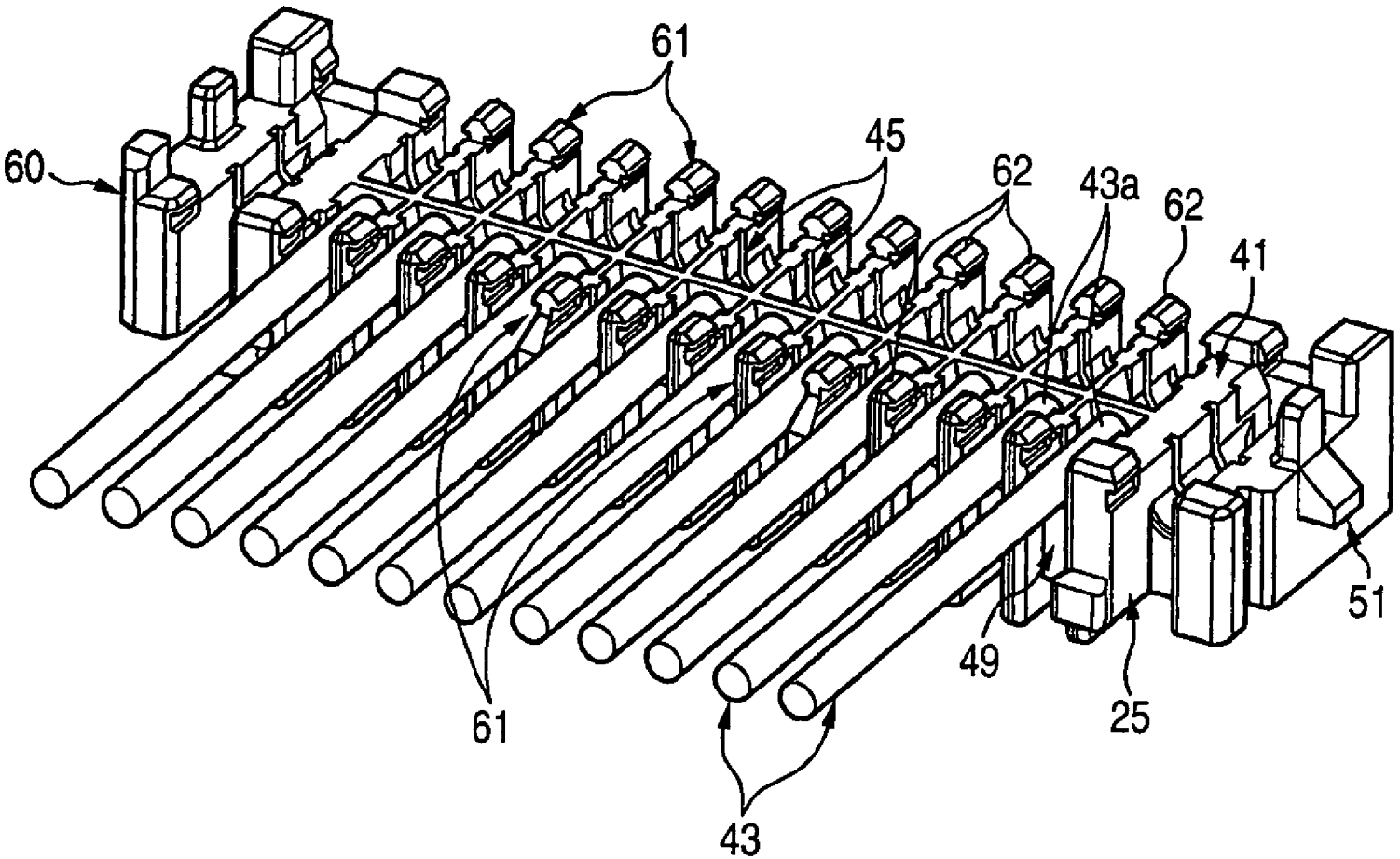
FIG. 5 is a perspective view showing a condition in which the wires are bent from the condition of FIG. 4, so that press-contacting portions of the wires are received and held respectively in press-contacting portion-holding grooves in the wire holder.

As shown in FIGS. 3 to 5, the wire holder 25 includes press-contacting portion-holding grooves 45 which are formed in a press-contacting blade-facing face 41 (facing in the direction of advancing of the press-contacting blades 29*a*) so as to respectively position press-contacting portions 43*a* of the sheathed wires 43 in a juxtaposed (parallel) manner, wire end-holding holes 47 which are formed respectively at one ends of the press-contacting portion-holding grooves 45 in the connector-fitting direction so as to respectively hold end portions of the sheathed wires 43, and extending portion-holding grooves 49 which are formed in opposite side faces 48 (spaced from each other in the direction of the breadth) of the wire holder, and communicate respectively with the other ends of the press-contacting portion-holding grooves 45 so as to respectively hold extending portions 43*b* of the sheathed wires 43 respectively disposed immediately rearwardly of the press-contacting portions 43*a*.

Figure 10:
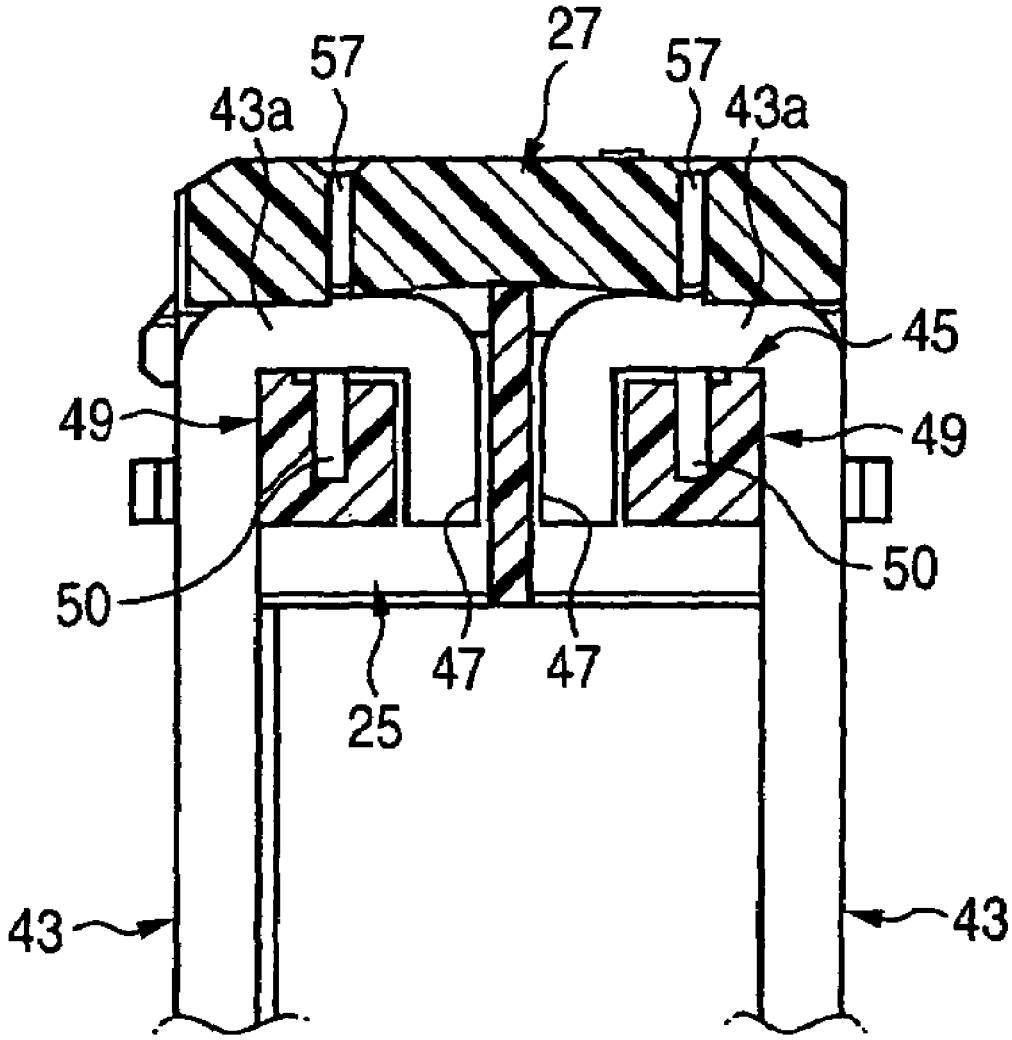
FIG. 10 is a cross-sectional view taken along the line X—X of FIG. 7.

As shown in FIG. 10, the press-contacting portion 43*a* of each sheathed wire 43 to be press-contacted with the press-contacting terminal 29 is held by the wire end-holding hole 47 and the extending portion-holding groove 49 in such a manner that the press-contacting portion 43*a* is bent at the opposite ends of the press-contacting portion-holding groove 45 to assume a U-shape.

The press-contacting portion-holding grooves 45, as well as the wire end-holding holes 47 and the extending portion-holding grooves 49, are so arranged that the end portions of the plurality of sheathed wires 43 can be held at intervals equal to the pitch at which the press-contacting blades 29*a* are arranged in the holder fitting portion 33.

As shown in FIG. 3, press-contacting blade escape grooves 50 each for the associated press-contacting portion-holding groove 45 are formed in the press-contacting blade-facing face 41 of the wire holder 25, and the distal end portions of the press-contacting blades 29*a* can be inserted into these escape grooves 50, respectively.

As shown in FIGS. 1 and 3, engagement projections 51 are formed on the longitudinal opposite end faces of the wire holder 25, respectively. Each engagement projection 51 has a tapering face 51*a* formed at its front end facing in the direction of fitting of the wire holder into the connector housing 23. When the wire holder 25 is fitted into the holder fitting portion 33 of the connector housing 23, the engagement projections 51 are brought into engagement respectively with the provisionally-retaining members 35 or the completely-retaining members 37 to perform a provisionally-fixing function or a completely-fixing function.

Here, description will be made of the condition in which the engagement projections 51 of the wire holder 25 are engaged respectively with the provisionally-retaining members 35 of the connector housing 23 and also of the condition in which the engagement projections 51 are engaged respectively with the completely-retaining members 37.

When the wire holder 25 is fitted into the holder fitting portion 33 of the connector housing 23, there is first achieved the provisionally-fitted condition in which the distal end portion of each press-contacting blade 29*a* does not yet reach the press-contacting portion 43*a* of the sheathed wire 43 held in the press-contacting portion-holding groove 45 as shown in FIG. 13. In this condition, the engagement projections 51 are engaged respectively with the provisionally-retaining member 35 as shown in FIG. 12B.

Figure 12A:
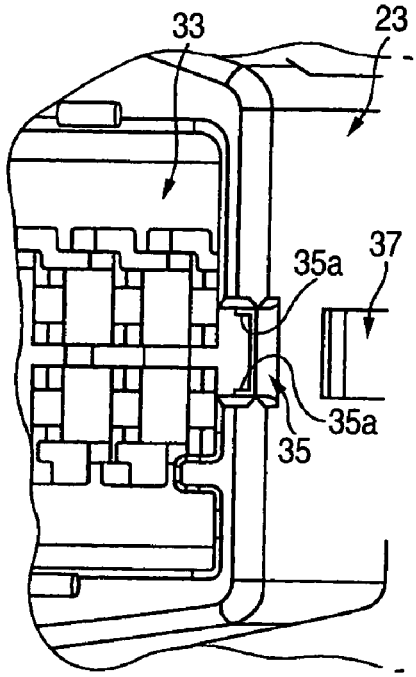
FIG. 12A is an enlarged, perspective view of an important portion, showing provisionally-retaining member provided at the connector housing.

Each provisionally-retaining member 35 is in the form of a notch into which the engagement projection 51 can fit. As shown also in FIG. 12A, a pair of elastic projections 35*a* for elastic contact with the engagement projection 51 are formed respectively on opposed edges of this notch for holding the engagement projection 51 therebetween.

When each engagement projection 51 is press-fitted into the provisionally-retaining member 35, the pair of elastic projections 35*a* are elastically deformed (and are partially crushed), and hold the engagement projection 51 therebetween by this contact pressure, so that the wire holder 25 is held in the provisionally-fitted condition relative to the connector housing 23 without shaking.

Figure 12B:
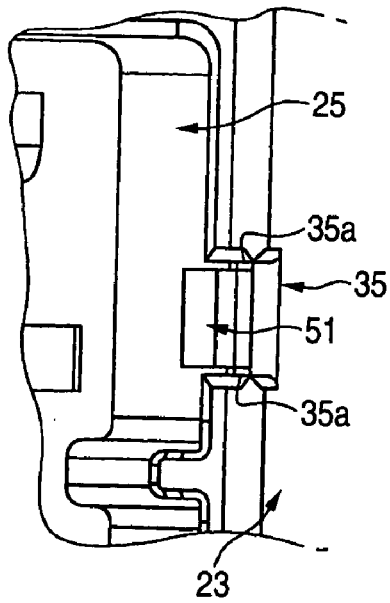
FIG. 12B is an enlarged, perspective view of an important portion, showing the provisionally-fitted condition of the wire holder.

Then, when the wire holder 25 is further pushed into the connector housing 23 from the provisionally-fitted condition shown in FIG. 12B, each engagement projection 51 is fitted into the completely-retaining member 37 disposed forwardly of the provisionally-retaining member 35.

Figure 11:
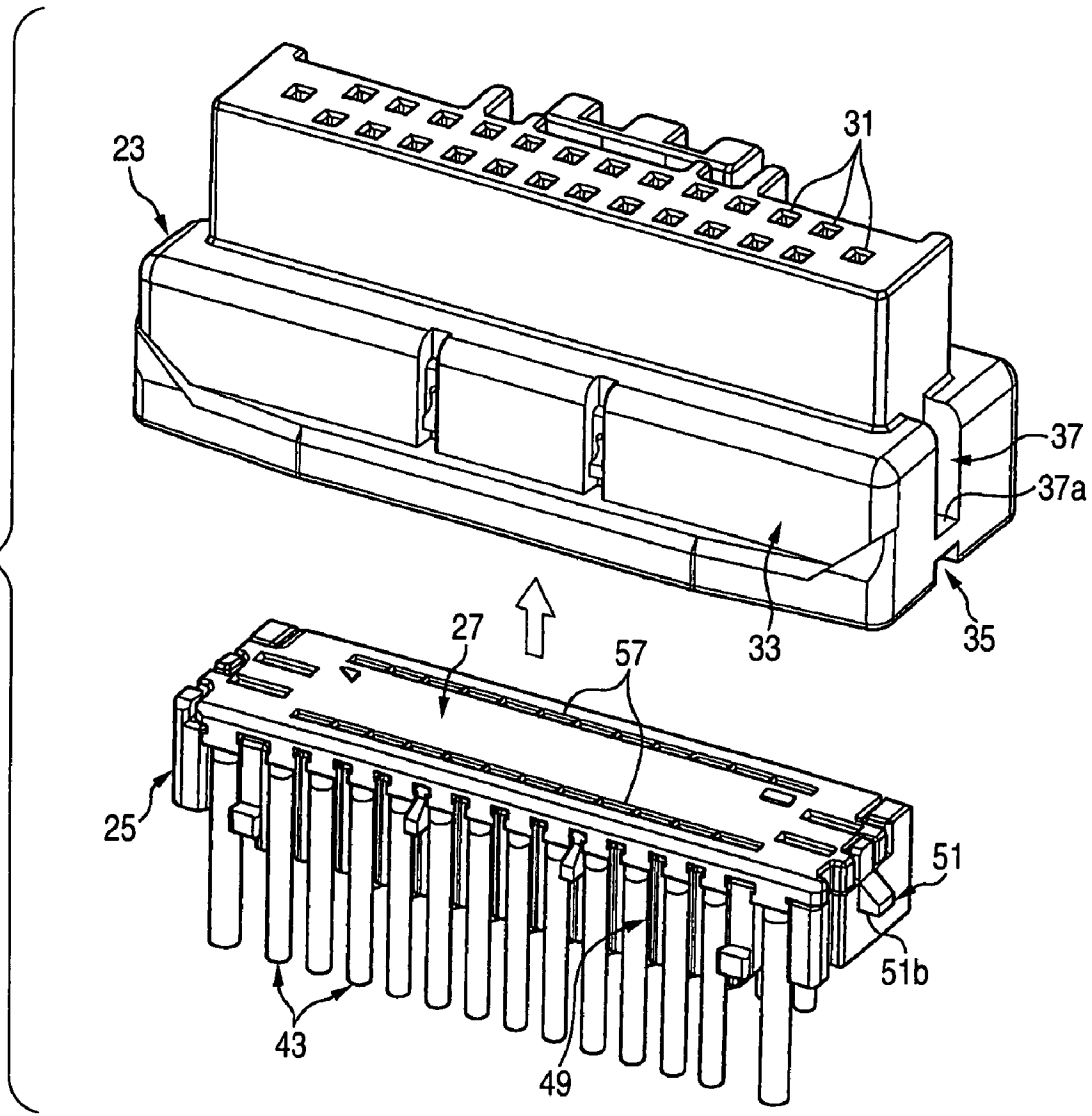
FIG. 11 a perspective view showing a condition before the wire holder, having the wires and the press-contact assisting plate mounted thereon, is fitted into a connector housing.

Each completely-retaining member 37 is in the form of a step portion for retaining the engagement projection 51, and when a rear step portion 51*b* of the engagement projection 51 is engaged with a retaining face 37*a* as shown in FIG. 11, the engagement projection 51 is retained.

Figure 2:
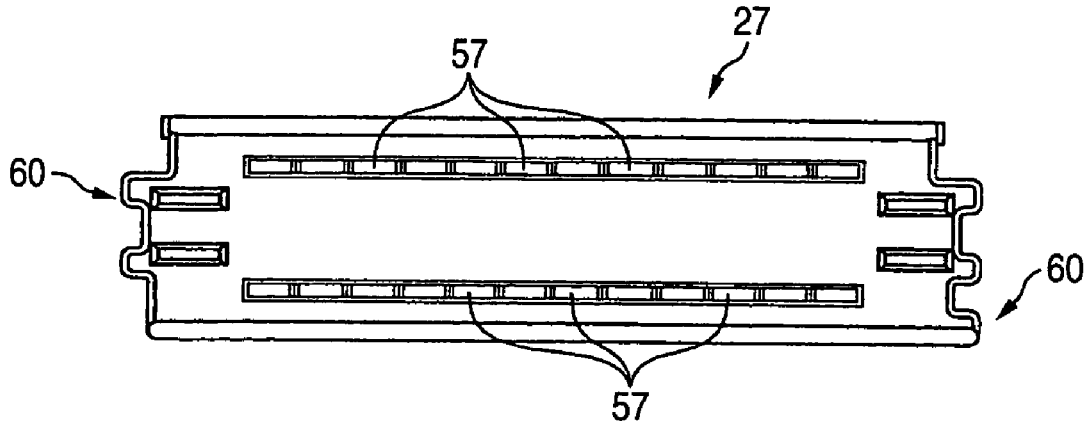
FIG. 2 is a plan view of a press-contact assisting plate shown in FIG. 1.

The press-contact assisting plate 27 is fittingly attached to the press-contacting blade-facing face 41 of the wire holder 25. As shown in FIGS. 1, 2 and 13, the press-contact assisting plate 27 includes wire-holding portions 55 for respectively press-holding the press-contacting portions 43*a* of the sheathed wires 43 held respectively in the press-contacting portion-holding grooves 45 of the wire holder 25, and press-contacting blade guide portions 57 which respectively receive the distal ends of the press-contacting blades 29*a* when the wire holder 25 is provisionally fitted in the holder fitting portion 33, and also serve to guide the press-contacting blades 29*a* respectively to the press-contacting portions 43*a* of the sheathed wires 43 when the wire holder 25 is completely fitted into the holder fitting portion.

In this first embodiment, although each of the press-contacting blade guide portions 57 is in the form of a through hole of a rectangular cross-section corresponding in cross-section to the press-contacting blade 29*a*, the press-contacting blade guide portion of the invention are not limited to such a through hole.

Interconnecting member 59 for maintaining the mutually-connected condition of the wire holder 25 and press-contact assisting plate 27, as well as erroneous insertion prevention member 60 for regulating the direction of attaching of the press-contact assisting plate 27, are provided between the wire holder 25 and the press-contact assisting plate 27.

In this first embodiment, each of the wire-holding portions 55 is in the form of a convex portion (as shown in FIGS. 1 and 13) which can fit into the press-contacting portion-holding groove 45 in the wire holder 25 to press the press-contacting portion 43*a* of the sheathed wire 43 against a bottom of the press-contacting portion-holding groove 45.

Figure 8:
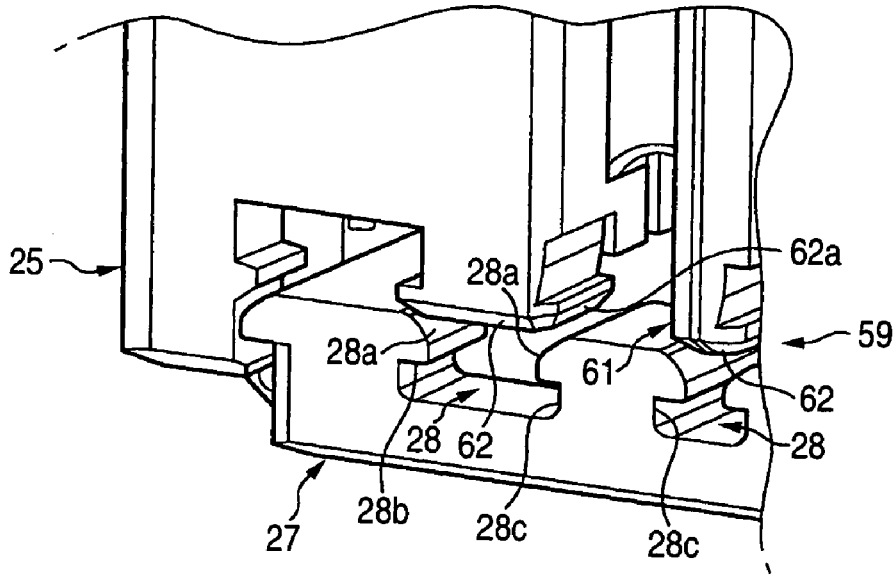
FIG. 8 is an enlarged, perspective view of an important portion, showing interconnecting member in a provisionally-fitted condition of the wire holder and press-contact assisting plate.
Figure 9:
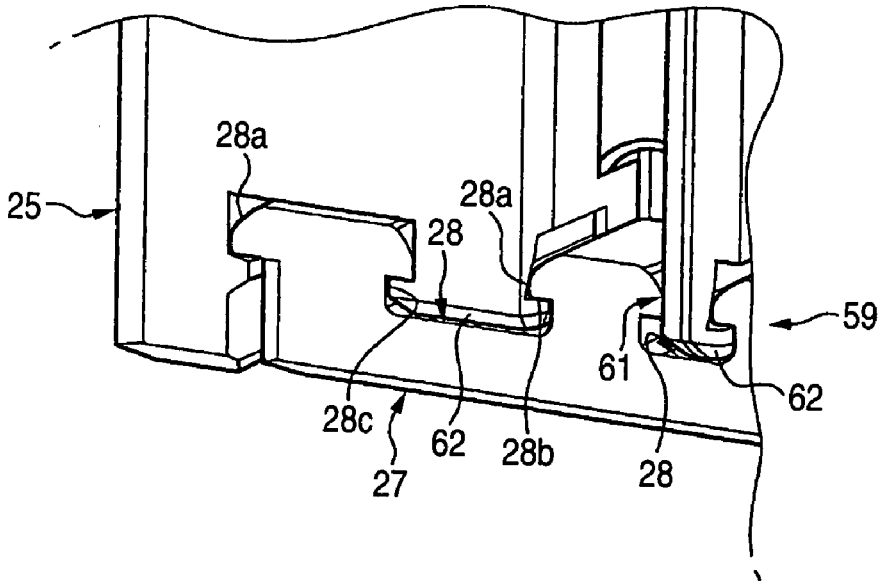
FIG. 9 is an enlarged, perspective view of the important portion, showing the interconnecting member in a completely-fitted condition of the wire holder and press-contact assisting plate.

As shown in FIGS. 8 and 9, the interconnecting member 59 includes ribs 61 formed on and projecting in the fitting direction from the press-contacting blade-facing face 41 of the wire holder 25, and fitting grooves 28 which are formed in the fitting face of the press-contact assisting plate 27 so as to respectively receive bulge portions 62 formed respectively at distal ends of the ribs 61.

The ribs 61 are projecting walls which are formed in an upstanding manner on the wire holder 25 in order to form the press-contacting portion-holding grooves 45 and the extending portion-holding grooves 49. The bulge portion 62 is formed at the distal end of the rib 61, and is bulged into a generally arrowhead-shape such that tapering faces 62*a* are formed respectively at opposite side portions thereof. The two tapering faces 62*a* function as guide faces to facilitate the fitting of the bulge portion 62 into the fitting groove 28.

As shown in FIG. 8, the fitting groove 28 has an inwardly-spreading engagement chamber 28*c* formed inwardly of a constricted portion 28*b* (formed at an inlet side) having tapering faces 28*a* corresponding to the tapering faces 62*a*.

Inclination angles of the tapering faces 28*a* and 62*a* of the fitting groove 28 and the bulge portion 62 are suitably selected so that damage or the like will not be caused by an abrupt stress change during the fitting operation.

As shown in FIGS. 2 and 3, the erroneous insertion prevention member 60 includes fitting convex portions and concave portions formed in an asymmetrical manner on the longitudinal opposite ends of each of the wire holder 25 and the press-contact assisting plate 27. The erroneous insertion prevention member 60 performs a positioning function and a fitting guide function when the press-contact assisting plate 27 is fittingly attached to the wire holder 25, and also performs an erroneous insertion prevention function with respect to the attaching direction.

In the press-contacting connector 21 according to the first embodiment, the plurality of sheathed wires 43 are collectively press-contacted respectively with the press-contacting terminals 29 according to the following procedure.

First, the end portions of the sheathed wires 43 are inserted respectively into the wire end-holding holes 47 in the wire holder 25 as shown in FIG. 4, and then the sheathed wires 43 are bent, and the press-contacting portions 43*a* thereof are received and held respectively in the press-contacting portion-holding grooves 45 as shown in FIG. 5.

Figure 6:
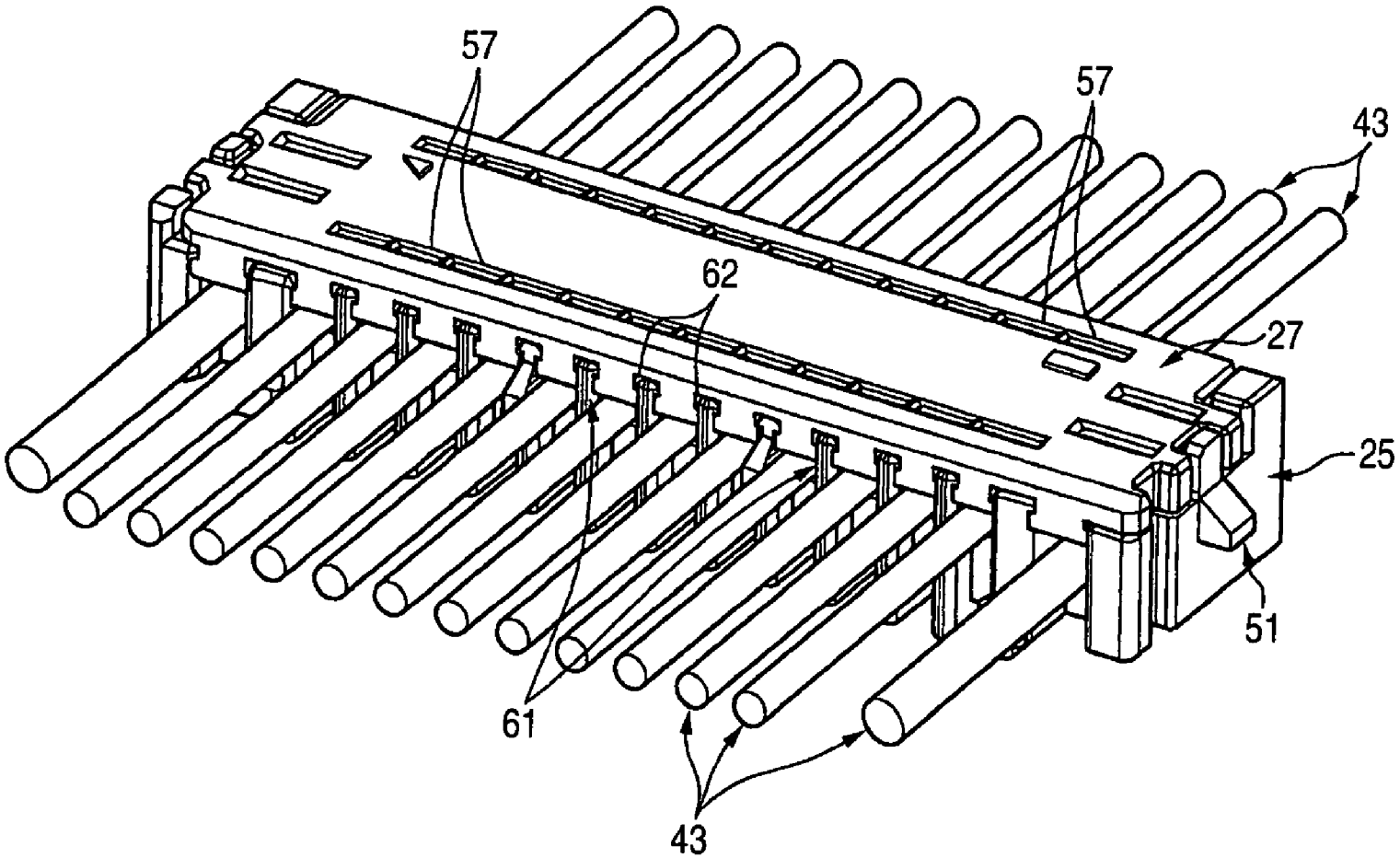
FIG. 6 is a perspective view showing a condition in which the press-contact assisting plate is fittingly attached to the wire holder of FIG. 5.
Figure 7:
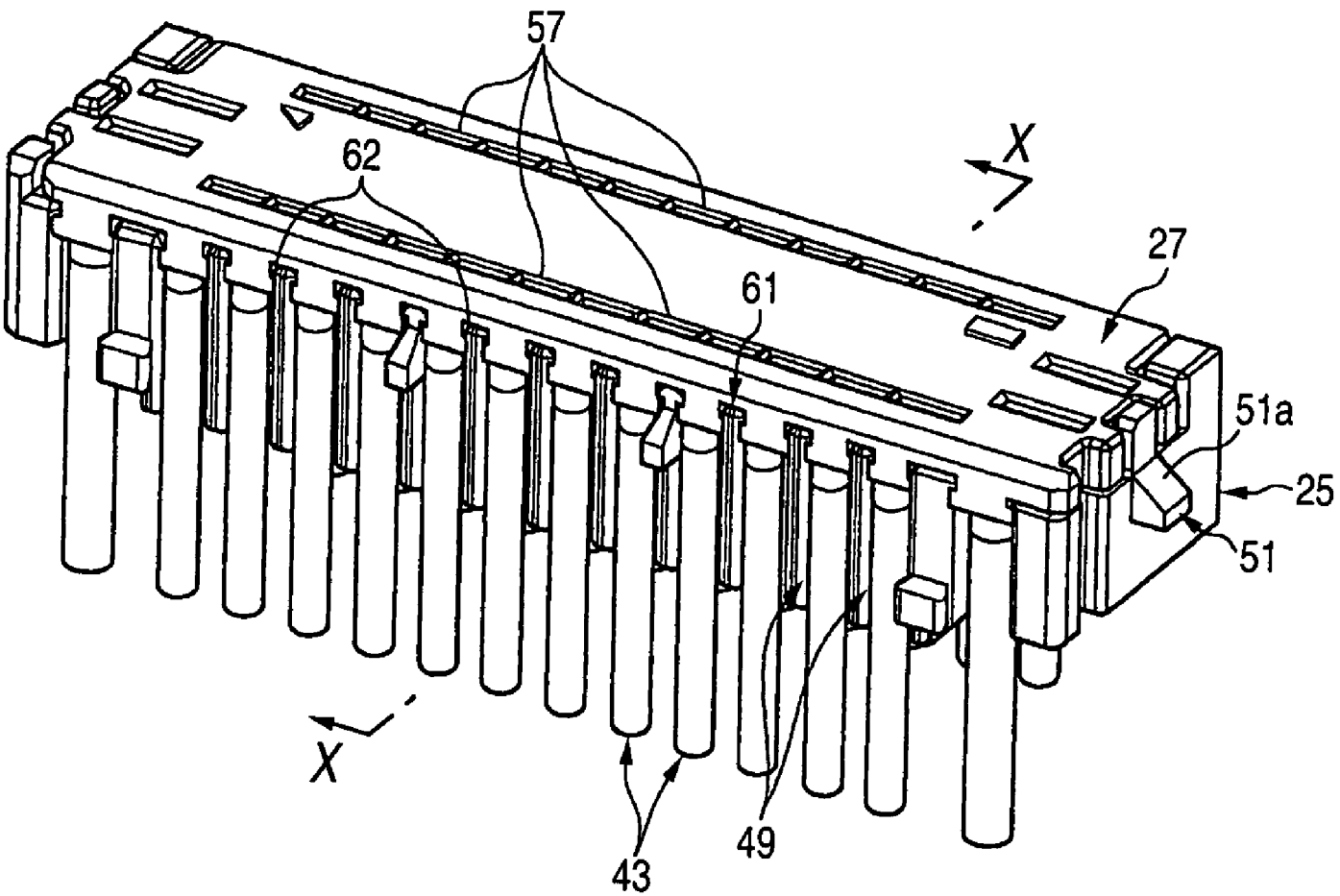
FIG. 7 is a perspective view showing a condition in which each row of wires are bent from the condition of FIG. 6 toward a side face of the wire holder, and are received and held respectively in extending portion-holding grooves.

Then, the press-contact assisting plate 27 is fittingly attached to the press-contacting blade-facing face 41 of the wire holder 25 as shown in FIG. 6, and then those portions of the sheathed wires 43, extending from the respective press-contacting portion-holding grooves 45 at the opposite sides of the wire holder, are bent, and the extending portions 43*b* of the wires, disposed immediately rearwardly of the respective press-contacting portions 43*a*, are received and held in the respective extending portion-holding grooves 49 in the wire holder 25 as shown in FIG. 7.

The wire holder 25 and the press-contact assisting plate 27 are held in the mutually-connected condition (as shown in FIG. 6) by the interconnecting member 59 shown in FIGS. 8 and 9, and the bulge portions 62 of the ribs 61 (which are the upstanding projecting walls arranged such that any two adjacent projecting walls are disposed respectively at the opposite sides of the corresponding press-contacting portion-holding groove 45) are fitted respectively in the fitting grooves 28, and therefore each of the plurality of sheathed wires 43 can be positively held in position.

When the press-contact assisting plate 27 is thus fittingly attached to the wire holder 25, the press-contacting portions 43*a* of the sheathed wires 43, held by the wire holder 25, are firmly press-held by the press-contact assisting plate 27, and therefore the sheathed wires 43 are prevented from lifting as shown in FIG. 10.

Then, the wire holder 25, cooperating with the press-contact assisting plate 27 to hold the press-contacting portions 43*a* of the sheathed wire 43 therebetween, is fitted into the holder fitting portion 33 of the connector housing 23 as shown in FIG. 11.

At this time, first, the wire holder 25 is provisionally fixed to the connector housing 23 by the provisionally-retaining member 35, so that the wire holder 25 is disposed in the provisionally-fitted condition in which the distal ends of the press-contacting blades 29*a* are inserted respectively in the press-contacting blade guide portions 57 of the press-contact assisting plate 27, but do not yet reach the press-contacting portions 43*a* of the sheathed wires 43 held on the wire holder 25, as shown in FIG. 13.

Figure 15:
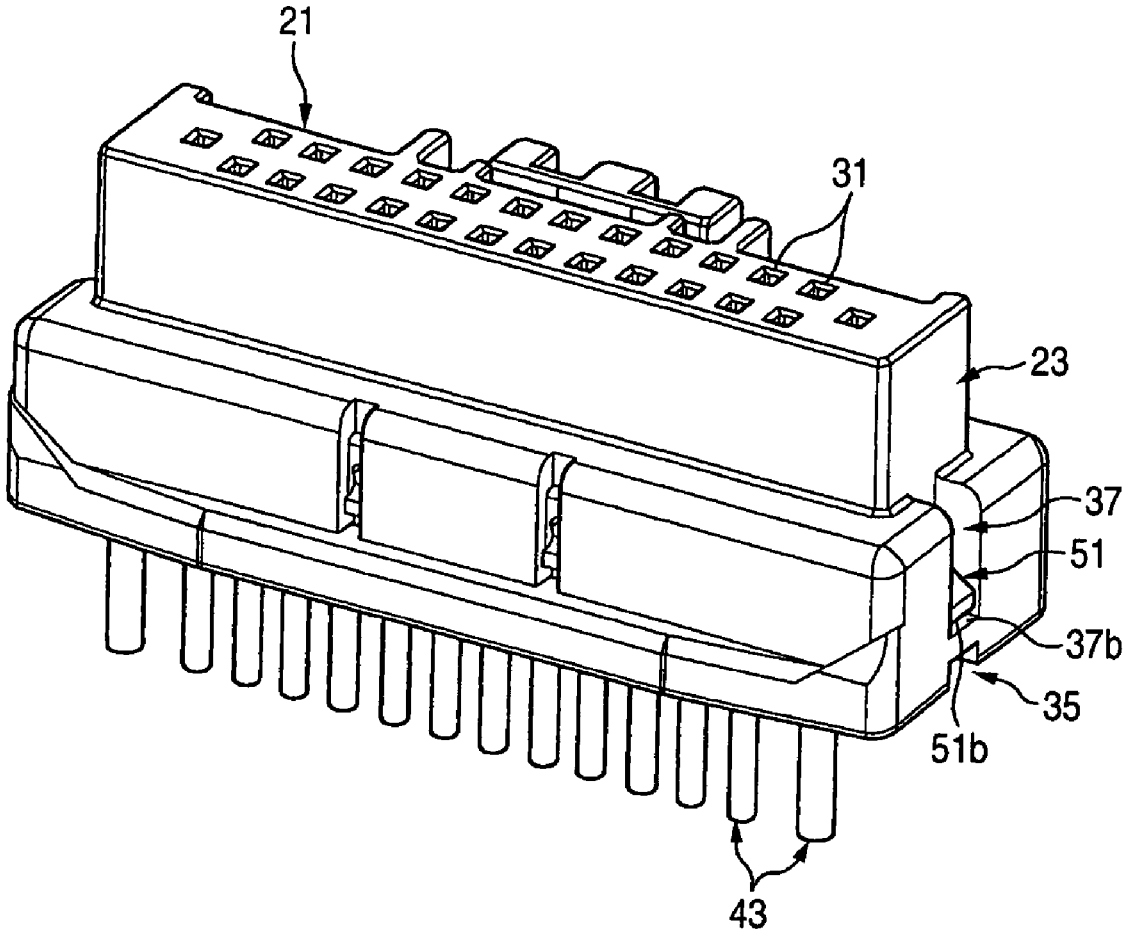
FIG. 15 is a perspective view showing the condition in which the wire holder and connector housing, shown in FIG. 11, are completely fitted together.

Then, the wire holder 25 is further pushed into the holder fitting portion 33 of the connector housing 23 by the use of a special-purpose connector fitting jig or the like, and by doing so, the wire holder 25 is completely fitted into the connector housing 23 as shown in FIG. 15.

As a result, the plurality of sheathed wires 43, held by the wire holder 25, are collectively press-contacted respectively with the press-contacting blades 29*a* of the press-contacting terminals 29 in the connector housing 23.

Namely, in the press-contacting connector 21 of the first embodiment, when the press-contact assisting plate 27 is fittingly attached to the wire holder 25, the press-contacting portions 43 of the plurality of sheathed wires 43, held by the wire holder 25, are press-held between the wire holder 25 and the press-contact assisting plate 27. Therefore, until the wire holder 25 is completely fitted into the holder fitting portion 33 of the connector housing 23, the press-contacting portions 43*a* of the sheathed wires 43, held by the wire holder 25, are positively prevented from displacement such as lifting.

When the wire holder 25, having the press-contact assisting plate 27 fittingly attached thereto, is provisionally fitted into the holder fitting portion 33 of the connector housing 23, the distal ends of the press-contacting blades 29*a* of the press-contacting terminals 29, received and held in the connector housing 23, are received respectively in the press-contacting blade guide portions 57 of the press-contact assisting plate 27, and therefore the distal end of each press-contacting blade 29*a* is supported in a proper position by the press-contacting blade guide portion 57.

Therefore, when a pressing operation is effected for shifting the wire holder 25 from the provisionally-fitted condition to the completely-fitted condition relative to the connector housing 23, the deflection, buckling, etc., of the press-contacting blades 29*a*, inviting the incomplete press-contact, can be positively prevented, and the plurality of sheathed wires 43 can be collectively press-contacted respectively with the press-contacting terminals 29 in a stable manner.

In this first embodiment, the wire holder 25 includes the press-contacting portion-holding grooves 45 which are formed in the press-contacting blade-facing face 41 so as to respectively position the press-contacting portions 43*a* of the sheathed wires 43 in a juxtaposed (parallel) manner, the wire end-holding holes 47 which are formed respectively at the one ends of the press-contacting portion-holding grooves 45 so as to respectively hold the end portions of the sheathed wires 43, and the extending portion-holding grooves 49 which are formed in the opposite side faces 48 of the wire holder, and communicate respectively with the other ends of the press-contacting portion-holding grooves 45 so as to respectively hold the extending portions 43*b* of the sheathed wires 43. Each sheathed wire 43 is kept bent at the opposite ends of its press-contacting portion 43*a* by the corresponding wire end-holding hole 47 and extending portion-holding groove 49.

Thus, each sheathed wire 43, held by the wire holder 25, is kept bent at an angle of about 90 degrees at the opposite ends of its press-contacting portion 43*a*, and these wire bent portions, formed respectively at the opposite ends of the press-contacting portion 43*a*, function as tension-proof portions for withstanding a tension acting on the sheathed wire 43.

Further, the end portion of each sheathed wire 43, disposed near to the press-contacting portion 43*a* thereof, is inserted and held in the wire end-holding hole 47, and therefore it is not necessary to effect an end portion-processing operation for preventing leakage at the end portion of each sheathed wire 43, so that the efficiency of the operation is enhanced.

In the first embodiment, the provisionally-retaining member 35 for retaining the wire holder 25 in the provisionally-fitted condition relative to the holder fitting portion 33 are provided between the connector housing 23 and the wire holder 25.

The wire holder 25 is provisionally fitted in the connector housing 23, and in this condition the two are moved to be put on the connector fitting jig or the like, and the two are completely fitted together, thereby collectively press-contacting the plurality of sheathed wires 43 with the press-contacting blades 29, respectively. At this time, the wire holder 25 is prevented from being disengaged from the connector housing 23 during the movement.

The press-contacting terminals, the connector housing, the wire holder, the press-contact assisting plate, etc., of the press-contacting connector of the invention are not limited to their respective constructions in the above first embodiment, and they can take any other suitable form on the basis of the subject matter of the invention.

Figure 16:
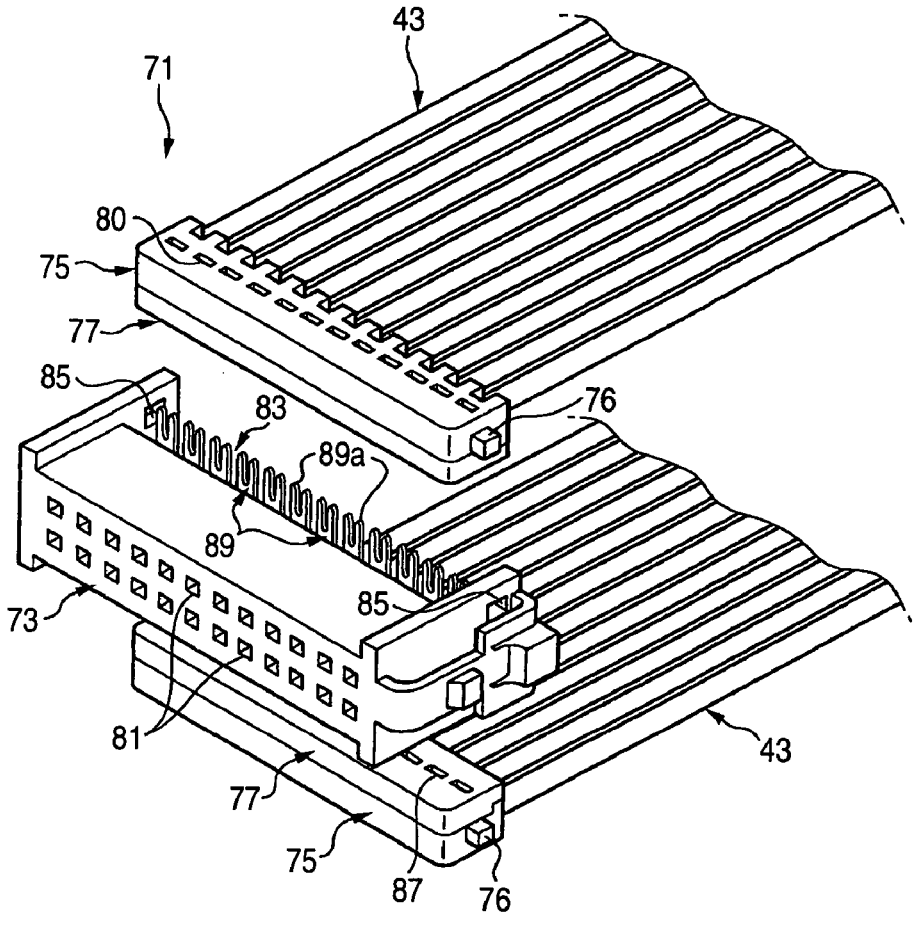
FIG. 16 is an exploded, perspective view of a press-contacting connector according to a second embodiment of the invention.
Figure 17:
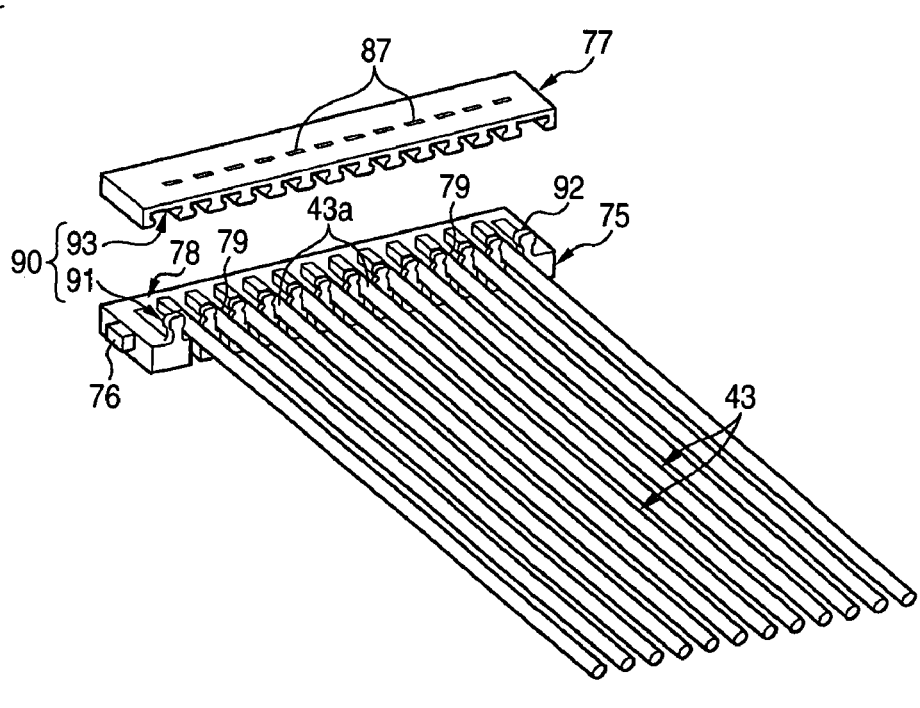
FIG. 17 is an exploded, perspective view showing a wire holder and a press-contact assisting plate of FIG. 16.
Figure 18:
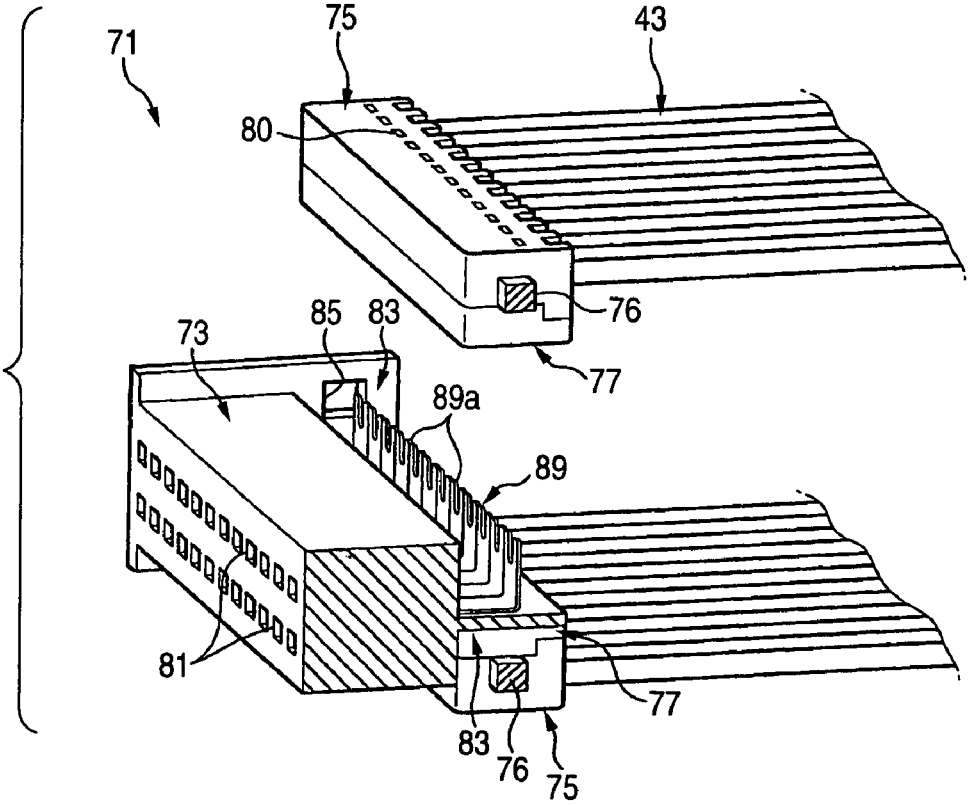
FIG. 18 is a partially cross-sectional, perspective view showing the procedure of mounting the wire holder of FIG. 16 on a connector housing.

As shown in FIGS. 16 to 18, a press-contacting connector 71 according to a second embodiment of the invention includes a connector housing 73, wire holders 75, and press-contact assisting plates 77.

The connector housing 73 receives and holds a plurality of press-contacting terminals 89 arranged in two (upper and lower) rows, and has a pair of holder fitting portions 83. Press-contacting blades 89*a* of the upper row of press-contacting terminals 89, received and held in the connector housing, project toward the upper side of the connector (that is, upwardly in FIG. 16) in the upper holder fitting portion 83, while press-contacting blades 89*a* of the lower row of press-contacting terminals 89 project toward the lower side of the connector (that is, downwardly in FIG. 16) in the lower holder fitting portion 83. The press-contacting terminals 89 are fitted respectively in terminal receiving holes 81 formed through the connector housing in a direction of fitting of this connector into a mating connector.

Retaining holes 85 are formed respectively in longitudinal opposite end walls of each holder fitting portion 83, and when the wire holder 75 is fitted into the holder fitting portion 83, the wire holder 75 is held and fixed through these retaining holes 85. These retaining holes 85 are retainingly engaged respectively with engagement projections 76 formed respectively on longitudinal opposite end faces of the wire holder 75.

In the second embodiment, each of the press-contacting terminals 89 to be mounted in the connector housing 73 has a terminal fitting portion (not shown) formed at one end thereof for fitting connection to a connection terminal in a mating connector housing. The press-contacting terminal 89 also has the press-contacting blade 89*a* (including a pair of blade portions) formed at the other end thereof so as to cut a sheath of a sheathed wire 43 to be press-contacted with a conductor within this sheathed wire, the press-contacting terminal being bent at right angles.

As shown in FIG. 17, the wire holder 75 includes press-contacting portion-holding grooves 79 which are formed in a press-contacting blade-facing face 78 (facing in the direction of advancing of the press-contacting blades 79*a*) so as to respectively position press-contacting portions 43*a* of the sheathed wires 43 in a juxtaposed (parallel) manner.

The press-contacting portion-holding grooves 79 are so arranged that the press-contacting portions (end portions) 43*a* of the plurality of sheathed wires 43 can be held at intervals equal to the pitch at which the press-contacting blades 89*a* are arranged in the holder fitting portion 83. There are formed press-contacting blade escape grooves 80 each for the associated press-contacting portion-holding groove 79, and the distal end portions of the press-contacting blades 89*a* can be inserted into the respective escape grooves 80

Each of the press-contact assisting plates 77 is fittingly attached to the press-contacting blade-facing face 78 of the corresponding wire holder 75. This plate 77 includes wire-holding portions (not shown) for respectively press-holding the press-contacting portions 43*a* of the sheathed wires 43 held respectively in the press-contacting portion-holding grooves 79 of the wire holder 75, and press-contacting blade guide portions 87 which guide the press-contacting blades 89*a* respectively to the press-contacting portions 43*a* of the sheathed wires 43 when the wire holder is fitted into the holder fitting portion.

In this second embodiment, each of the press-contacting blade guide portions 87 is in the form of a through hole of a rectangular cross-section corresponding in cross-section to the press-contacting blade 89*a*.

Interconnecting member 90 for maintaining the mutually-connected condition of the wire holder 75 and press-contact assisting plate 77 is provided between the wire holder 75 and the press-contact assisting plate 77. As shown in FIG. 17, the interconnecting member 90 includes ribs 91 formed on and projecting in the fitting direction from the press-contacting blade-facing face 78 of the wire holder 75, and fitting grooves 93 which are formed in the fitting face of the press-contact assisting plate 77 so as to respectively receive bulge portions 92 formed respectively at distal ends of the ribs 91. This interconnecting member 90 is similar in construction and operation to the interconnecting member 59 of the first embodiment.

In the press-contacting connector 71 of this second embodiment, the plurality of sheathed wires 43 are collectively press-contacted respectively with the press-contacting terminals 89 according to the following procedure.

First, the press-contacting portions (end portions) 43*a* of the sheathed wires 43 are inserted and held respectively in the press-contacting portion-holding grooves 79 in the wire holder 75 as shown in FIG. 17.

Then, the press-contact assisting plate 77 is fittingly attached to the press-contacting blade-facing face 78 of the wire holder 75. At this time, the wire holder 75 and the press-contact assisting plate 77 are held in the mutually-connected condition by the interconnecting member 90 shown in FIG. 17, and the bulge portions 92 of the ribs 91 (which are upstanding projecting walls arranged such that any two adjacent projecting walls are disposed respectively at the opposite sides of the corresponding press-contacting portion-holding groove 79) are fitted respectively in the fitting grooves 93, and therefore each of the plurality of sheathed wires 43 can be positively held in position.

When the press-contact assisting plate 77 is thus fittingly attached to the wire holder 75, the press-contacting portions 43*a* of the sheathed wires 43, held by the wire holder 75, are firmly press-held by the press-contact assisting plate 77, and therefore are prevented from lifting.

Figure 19:
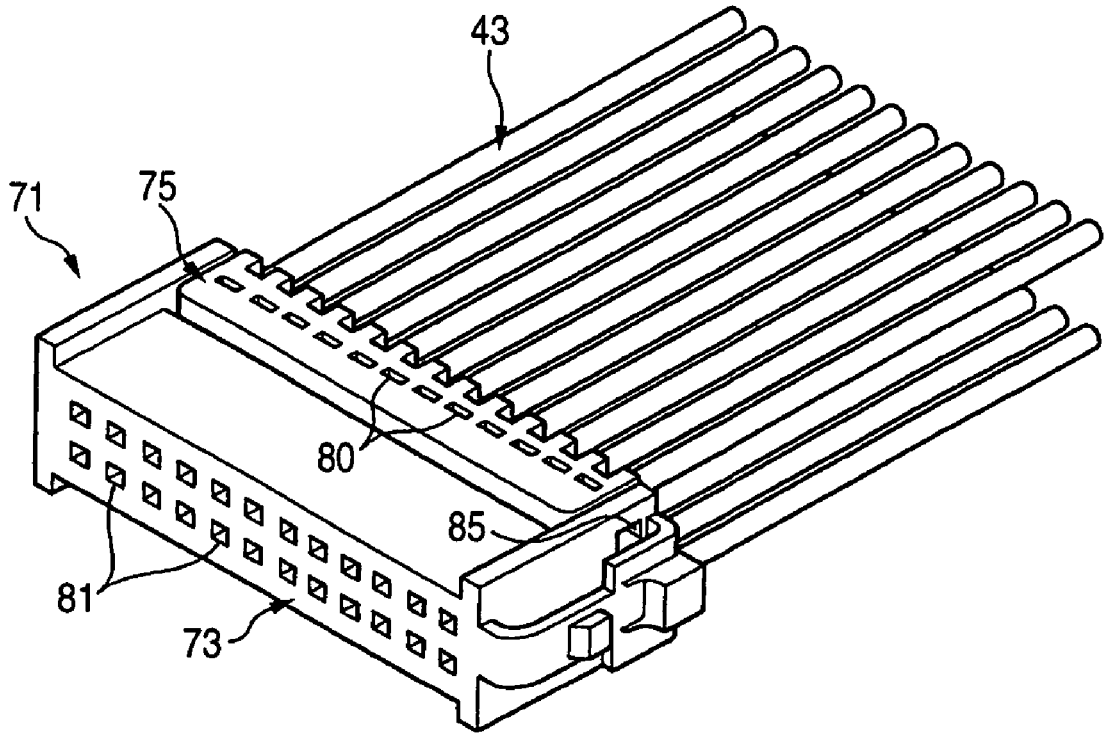
FIG. 19 is a perspective view showing a condition in which the wire holder and the connector housing of FIG. 16 are fitted together.

Then, the two wire holders 75, each cooperating with the corresponding press-contact assisting plate 77 to hold the press-contacting portions 43*a* of the sheathed wire 43 therebetween, are sequentially fitted respectively into the two holder fitting portions 83 formed respectively in the upper and lower sides of the connector housing 73, as shown in FIGS. 18 and 19. Each of the wire holders 75, thus fitted in the corresponding holder fitting portion 83, is fixed to the connector housing 73 by the engagement projections 76 retainingly engaged respectively in the retaining holes 85 formed in the connector housing 73.

At this time, first, the distal ends of the press-contacting blades 89*a* are received respectively in the press-contacting blade guide portions 87 of the press-contact assisting plate 77, and then a pressing operation is effected, and therefore the distal end of each press-contacting blade 89*a* is supported in a proper position by the press-contacting blade guide portion 87. Therefore, the deflection, buckling, etc., of the press-contacting blades 89*a*, inviting the incomplete press-contact, can be positively prevented, and the plurality of sheathed wires 43 can be collectively press-contacted respectively with the press-contacting terminals 89 in a stable manner.

In the press-contacting connector 71 of this second embodiment, the press-contacting portions 43*a* of the sheathed wires 43 can be received and held respectively in the press-contacting portion-holding grooves 79 of the wire holder 75 merely by press-fitting the end portions of the sheathed wires 43 respectively into the plurality of juxtaposed press-contacting portion-holding grooves 79 from the upper side. Therefore, this operation can be easily effected by an automatic assembling machine.

Figure 20:
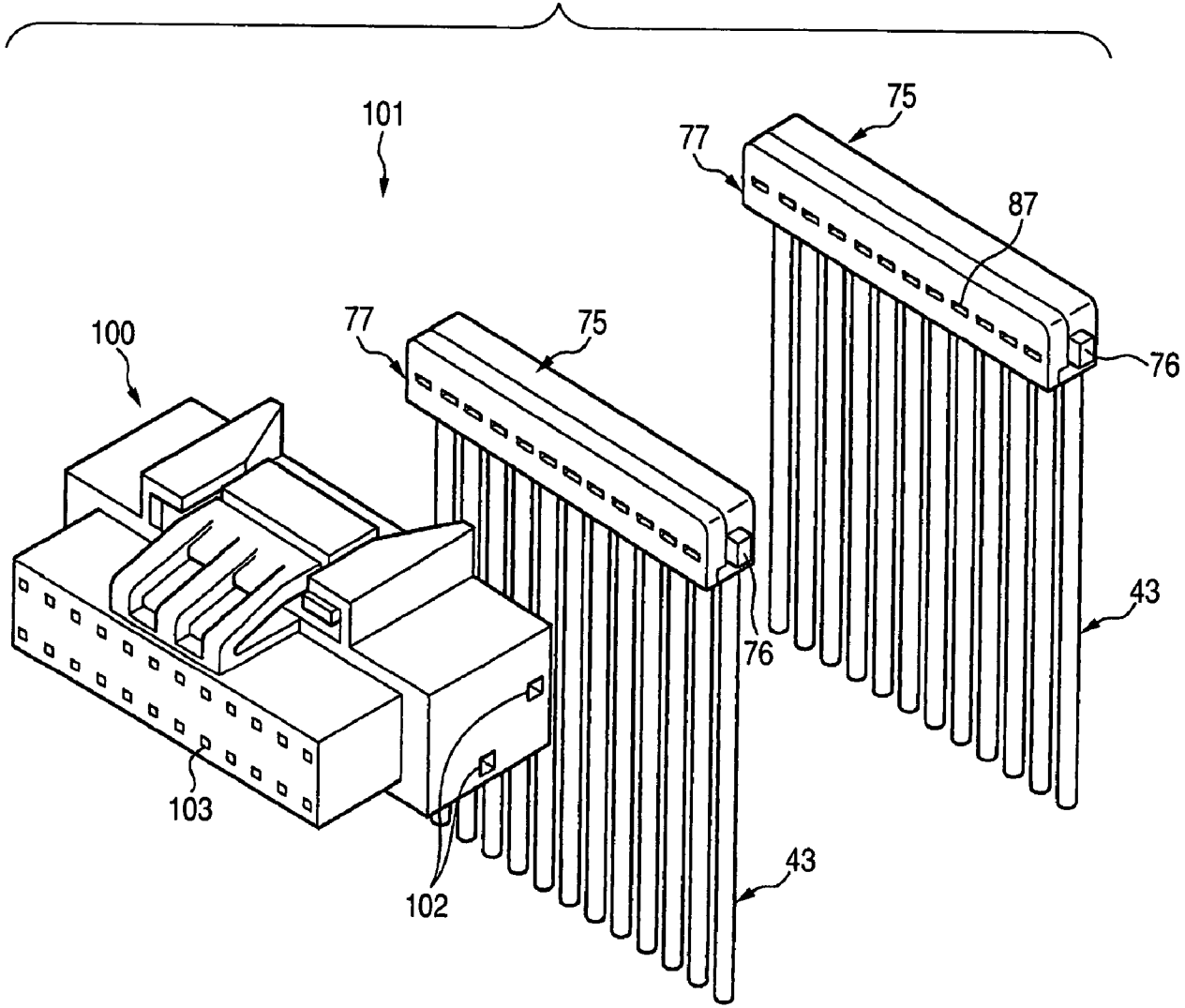
FIG. 20 is an exploded, perspective view of a press-contacting connector according to a third embodiment of the invention.
Figure 21:
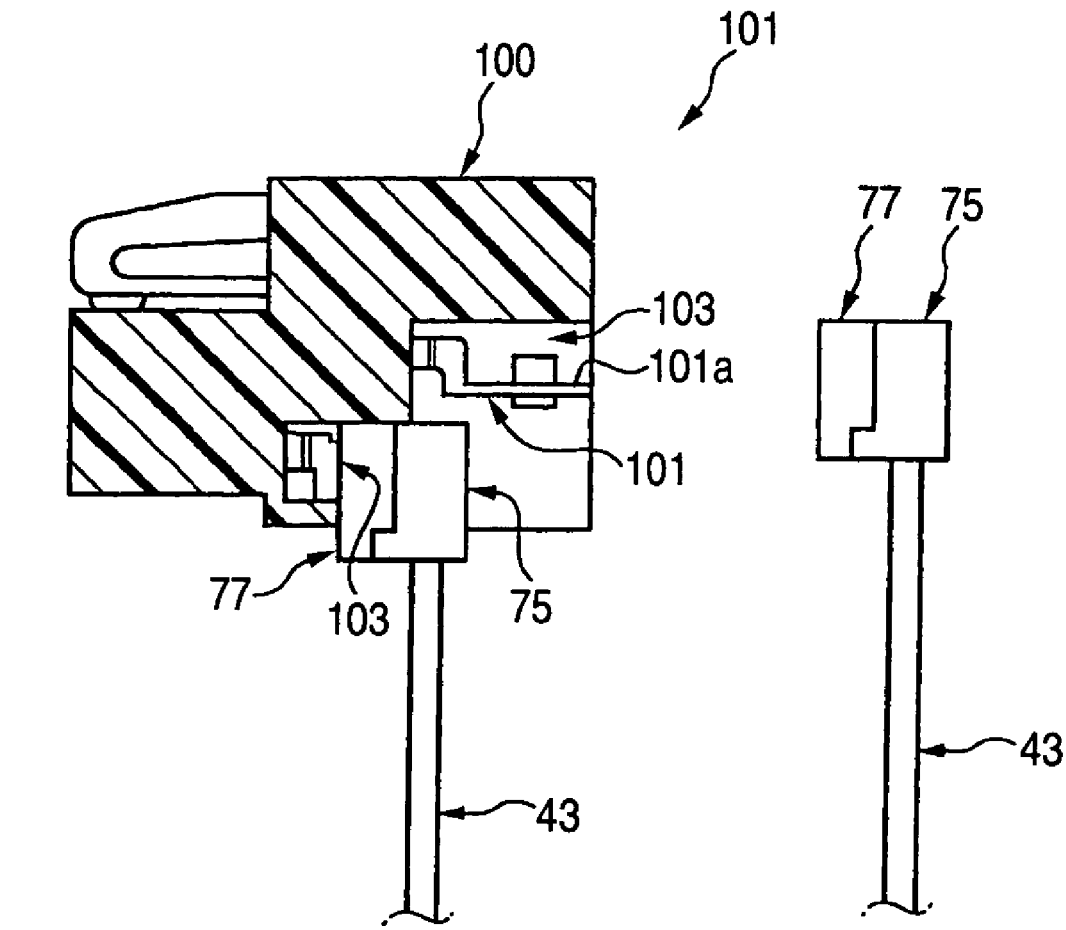
FIG. 21 is a vertical cross-sectional view showing the procedure of mounting wire holders of FIG. 20 on a connector housing.

As shown in FIGS. 20 and 21, a press-contacting connector 101 according to a third embodiment of the invention includes a connector housing 100, wire holders 75, and press-contact assisting plates 77. The wire holder 75 and the press-contact assisting plate 77 of the press-contacting connector 101 according to the third embodiment are similar in construction respectively to the wire holder 75 and press-contact assisting plate 77 of the press-contacting connector 71 of the second embodiment.

The connector housing 100 of this third embodiment receives and holds a plurality of press-contacting terminals 101 arranged in two (upper and lower) rows offset relative to each other, and the connector housing 100 has a pair of holder fitting portions 103 provided to assume a step-like configuration. Press-contacting blades 101*a* of each row of press-contacting terminals 101, received and held in the connector housing, project toward a rear side of the connector (that is, in a right-hand direction in FIG. 21) in the corresponding holder fitting portion 103. The press-contacting terminals 101 are fitted respectively in terminal receiving holes 103 formed through the connector housing in a direction of fitting of this connector into a mating connector.

The two wire holders 75, each cooperating with the corresponding press-contact assisting plate 77 to hold press-contacting portions 43*a* of sheathed wire 43 therebetween, are sequentially fitted respectively into the two holder fitting portions 103 formed in a rear portion of the connector housing 100, as shown in FIG. 21. Each of the wire holders 75, thus fitted in the corresponding holder fitting portion 103, is fixed to the connector housing 100 by engagement projections 76 retainingly engaged respectively in retaining holes 102 formed in the connector housing 100.

At this time, first, distal ends of the press-contacting blades 101*a* are received respectively in press-contacting blade guide portions 87 of the press-contact assisting plate 77, and then a pressing operation is effected, and therefore the distal end of each press-contacting blade 101*a* is supported in a proper position by the press-contacting blade guide portion 87. Therefore, the deflection, buckling, etc., of the press-contacting blades 101*a*, inviting the incomplete press-contact, can be positively prevented, and the plurality of sheathed wires 43 can be collectively press-contacted respectively with the press-contacting terminals 101 in a stable manner.

Figure 22A:
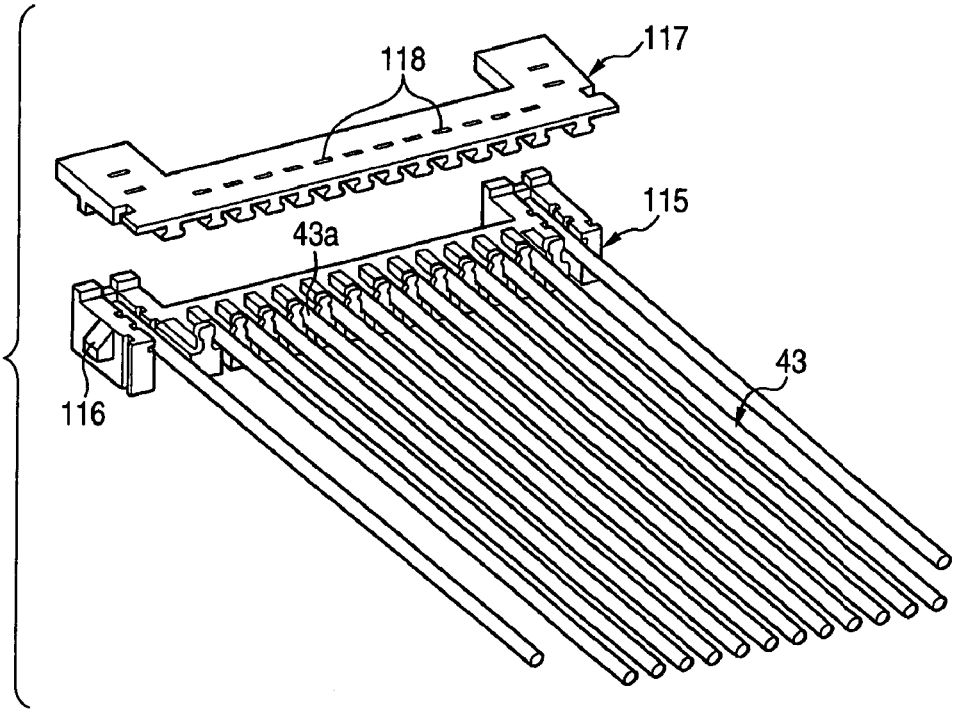
FIG. 22A is an exploded, perspective view of a fourth embodiment of a press-contacting connector of the invention, showing a first wire holder and a first press-contact assisting plate.
Figure 22B:
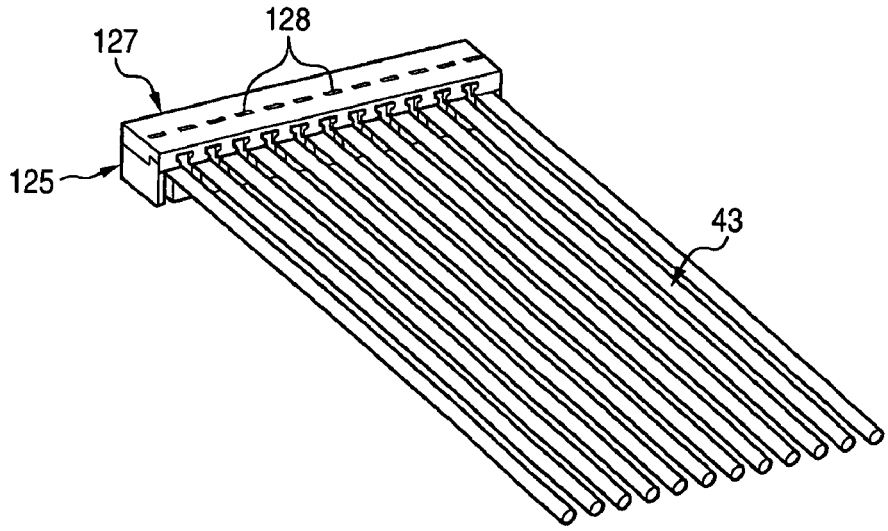
FIG. 22B is a perspective view showing a second wire holder and a second press-contact assisting plate of the press-contacting connector.
Figure 23:
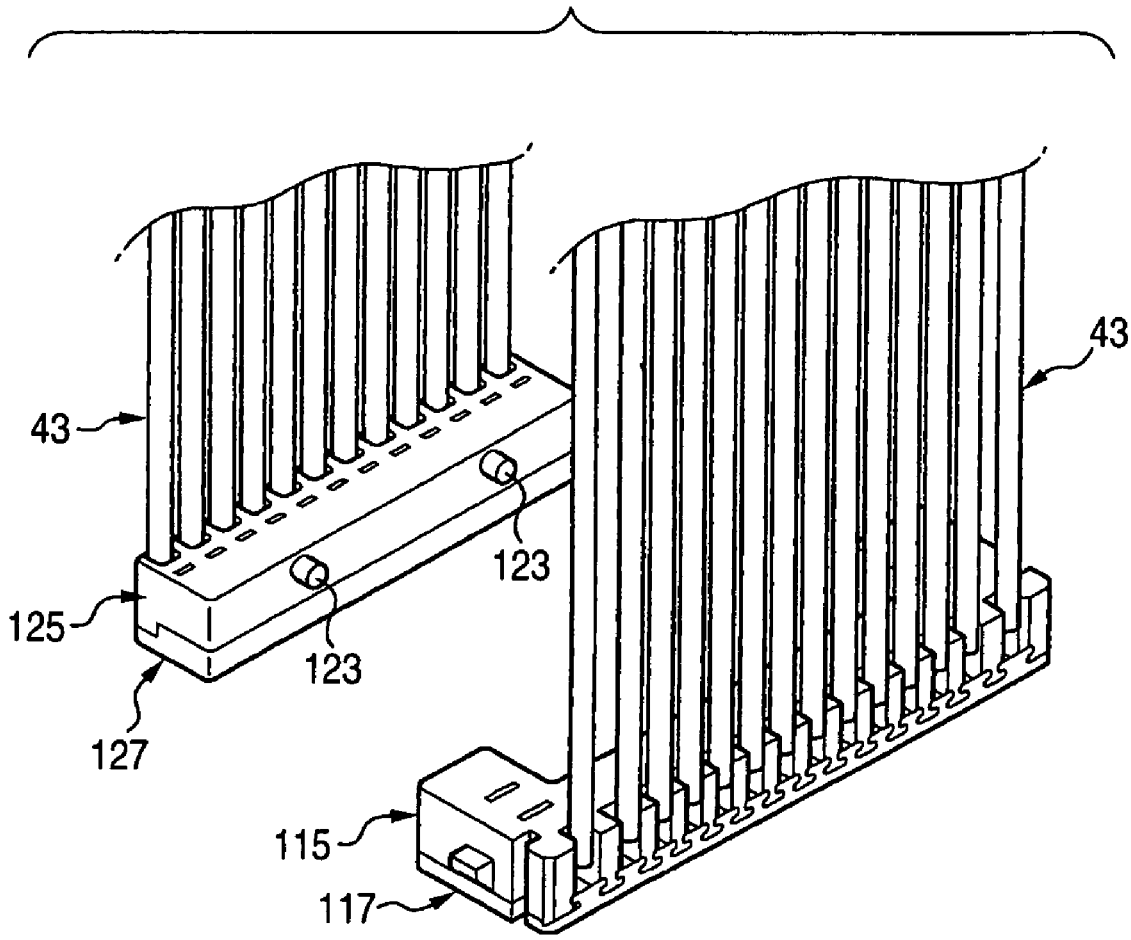
FIG. 23 is a perspective view explanatory of the fitting connection between the first wire holder (of FIG. 22) with the first press-contact assisting plate and the second wire holder with the second press-contact assisting plate.
Figure 24:
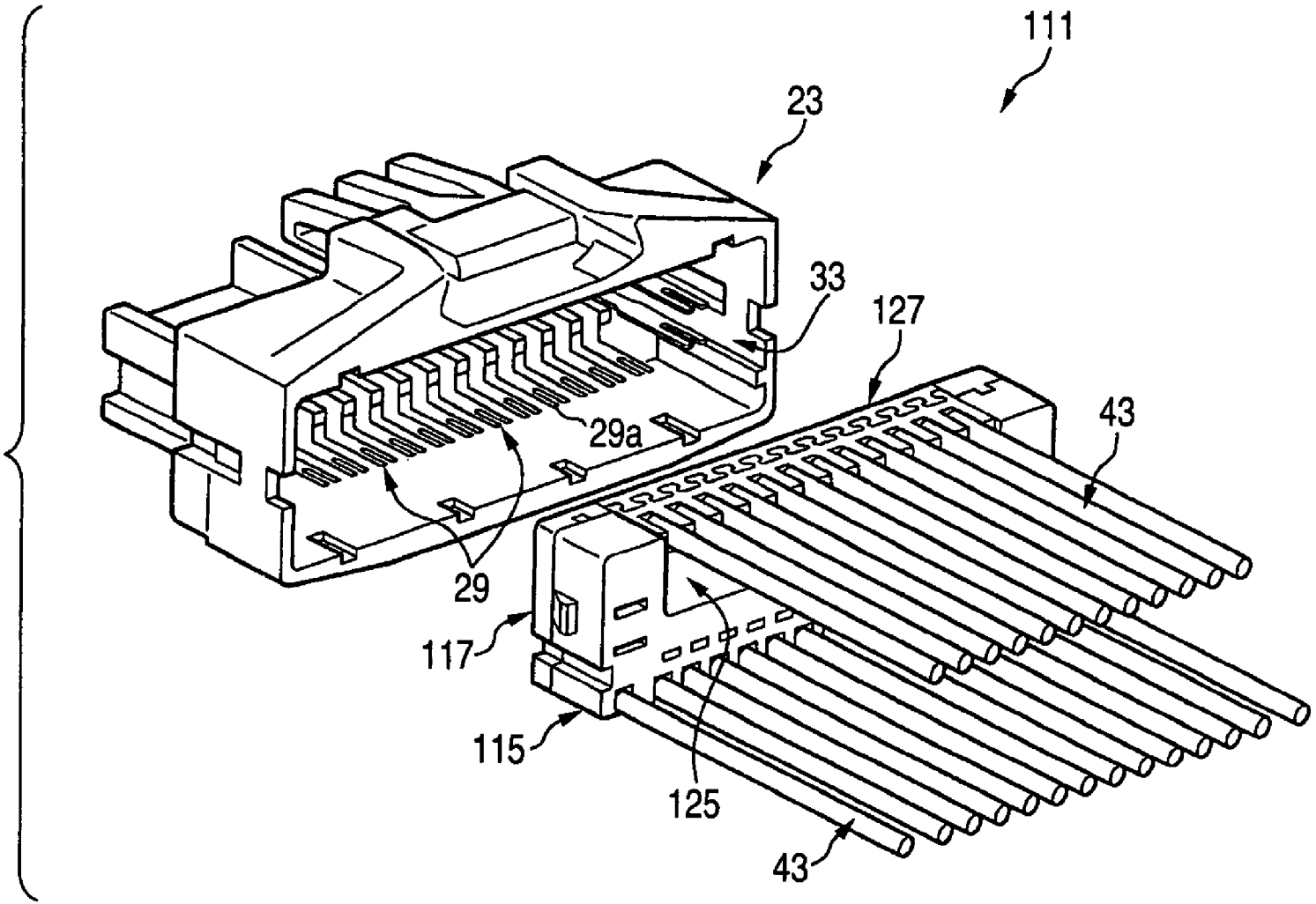
FIG. 24 an exploded, perspective view of a press-contacting connector according to a fourth embodiment of the invention.

As shown in FIGS. 22 to 24, a press-contacting connector 111 according to a fourth embodiment of the invention includes a connector housing 23, a first wire holder 115, a first press-contact assisting plate 117, a second wire holder 125, and a second press-contact assisting plate 127. The connector housing 23 of the press-contacting connector 111 of the fourth embodiment is similar in construction to the connector housing 23 of the press-contacting connector 21 of the first embodiment.

In this fourth embodiment, the first wire holder 115 and the first press-contact assisting plate 117, shown in FIG. 22A, are generally similar in construction respectively to the wire holder 75 and press-contact assisting plate 77 of the second embodiment except that they have a generally U-shape when viewed from the front side thereof. When the first press-contact assisting plate 117 is fittingly attached to the first wire holder 115, press-contact portions 43*a* of a plurality of wires 43 are press-held between the first press-contact assisting plate 117 and the first wire holder 115.

In this fourth embodiment, the second wire holder 125 and the second press-contact assisting plate 127, shown in FIG. 22B, are generally similar in construction respectively to the wire holder 75 and press-contact assisting plate 77 of the second embodiment. However, instead of the engagement projections 76 (which are retainingly engaged respectively in the retaining holes 85 in the connector housing 73), a pair of fitting projections 123 for fitting respectively in fitting holes (not shown) in the first wire holder 115 are formed on a side face of the second wire holder 125 (see FIG. 23).

The first wire holder 115, cooperating with the first press-contact assisting plate 117 to hold the press-contacting portions 43*a* of the sheathed wires 43 therebetween, and the second wire holder 125, cooperating with the second press-contact assisting plate 127 to hold the press-contacting portions 43*a* of the sheathed wires 43 therebetween, are fittingly connected together in a complementary manner, and therefore are combined together in an integral manner as shown in FIG. 23.

Thereafter, the first and second wire holders 115 and 125, thus combined together, are pushed to be fitted into a holder fitting portion 33 of the connector housing 23 by the use of a special-purpose connector fitting jig or the like.

As a result, the plurality of sheathed wires 43, held by the first and second wire holders 115 and 125, are collectively press-contacted respectively with press-contacting blades 29*a* of press-contacting terminals 29 provided in the connector housing 23.

Namely, in the press-contacting connector 111 of this fourth embodiment, the press-contacting portions 43*a* of the sheathed wires 43 can be received and held respectively in press-contacting portion-holding grooves of each of the first and second wire holders 115 and 125 merely by press-fitting the end portions of the sheathed wires 43 respectively into the plurality of juxtaposed press-contacting portion-holding grooves from the upper side as described above for the wire holder 75 of the press-contacting connector 71 of the second embodiment. Therefore, this operation can be easily effected by an automatic assembling machine.

As shown in FIGS. 25 to 28, a press-contacting connector 201 according to a fifth embodiment of the invention is a joint connector including a connector housing 210, a wire holder 221, a press-contact assisting plate 222, and a joint-purpose wires 240.

The connector housing 210 receives and holds press-contacting terminals 241 press-fastened respectively to end portions of the plurality of joint-purpose wires 240, and this connector housing 210 has a holder fitting portion 213 into which press-contacting blades 241*a* of the plurality of press-contacting terminals 241 project. The press-contacting terminals 241 are inserted respectively into terminal receiving holes 212 (formed through the connector housing in a direction of fitting of this connector into a mating connector) from the rear side, and are retained by retaining lances (not shown), respectively (see FIG. 27).

Figure 25:
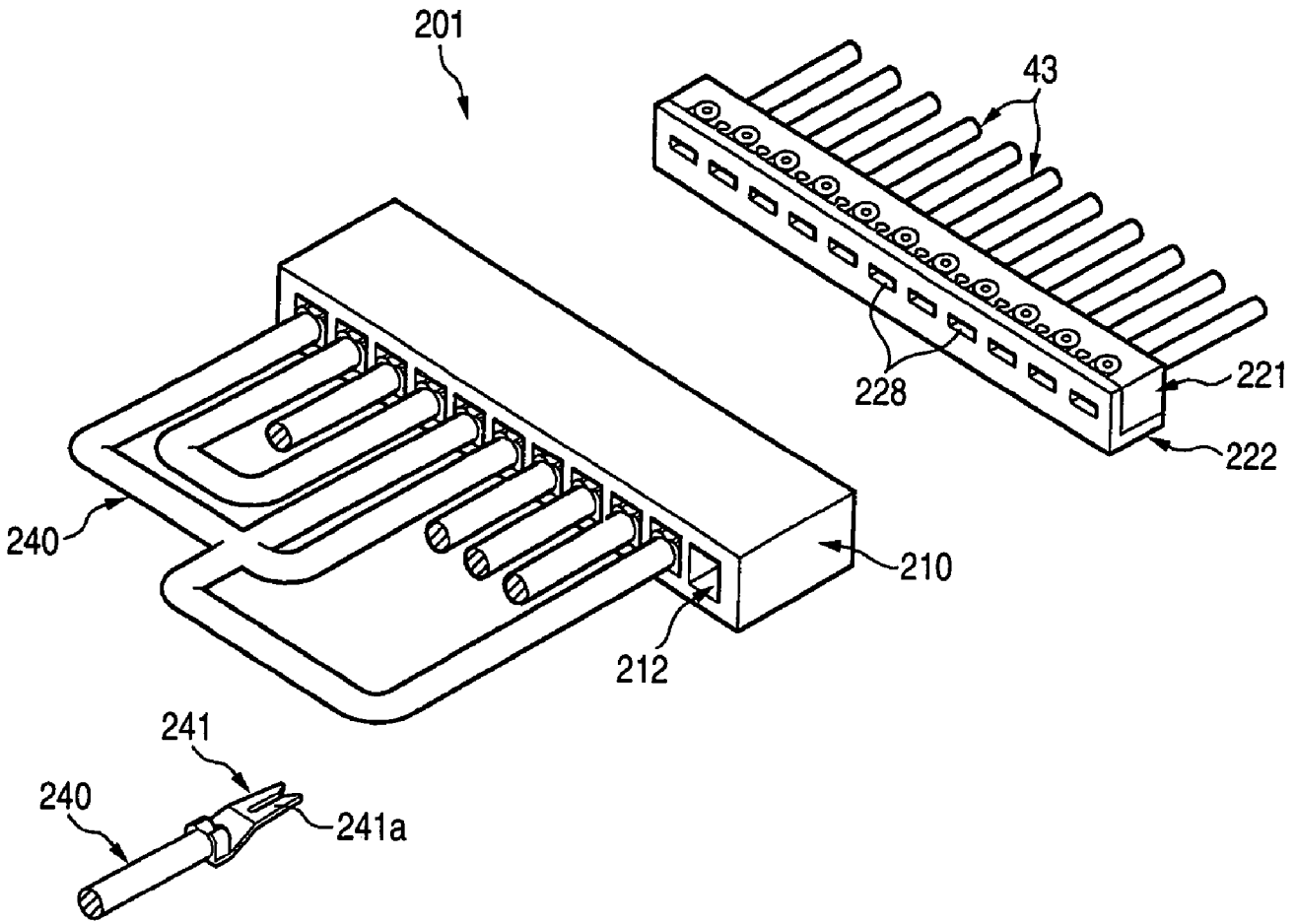
FIG. 25 is an exploded, perspective view of a press-contacting connector according to a fifth embodiment of the invention.

In this fifth embodiment, each of the press-contacting terminals 241 to be mounted in the connector housing 210 has the press-contacting blade 241*a* (including a pair of blade portions) formed at one end thereof (as shown in FIG. 25) so as to cut a sheath of a sheathed wire 43 to be press-contacted with a conductor within this sheathed wire. A wire connection portion for being press-fastened to the end portion of the joint-purpose wire 240 is formed at the other end of the press-contacting terminal 241.

Figure 26A:
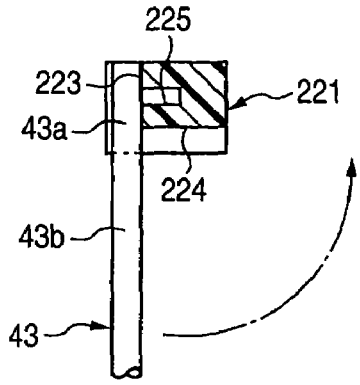
FIGS. 26A and 26B are vertical cross-sectional views explanatory of the procedure of assembling a wire holder and a press-contact assisting plate of FIG. 25 together.

As shown in FIG. 26A, the wire holder 221 includes press-contacting portion-holding grooves 223 which are formed in a press-contacting blade-facing face (facing in the direction of advancing of the press-contacting blades 241*a*) so as to respectively position press-contacting portions (end portions) 43*a* of the sheathed wires 43 in a juxtaposed (parallel) manner, and extending portion-holding grooves 224 which are formed in a side face of the wire holder, and communicate respectively with the press-contacting portion-holding grooves 223 so as to respectively hold extending portions 43*b* of the sheathed wires 43 respectively disposed immediately rearwardly of the press-contacting portions 43*a*.

The end portion of each sheathed wire 43 to be press-contacted with the press-contacting terminal 241 is held by the press-contacting portion-holding groove 223 and the extending portion-holding groove 224 in such a manner that this end portion is bent into an L-shape.

The press-contacting portion-holding grooves 223, as well as the extending portion-holding grooves 224, are so arranged that the end portions of the plurality of sheathed wires 43 can be held at intervals equal to the pitch at which the press-contacting blades 241*a* are arranged in the holder fitting portion 213.

As shown in FIG. 26, press-contacting blade escape grooves 225 each for the associated press-contacting portion-holding groove 223 are formed in the press-contacting blade-facing face of the wire holder 221, and the distal end portions of the press-contacting blades 241*a* can be inserted into these escape grooves 225, respectively.

Figure 26B:
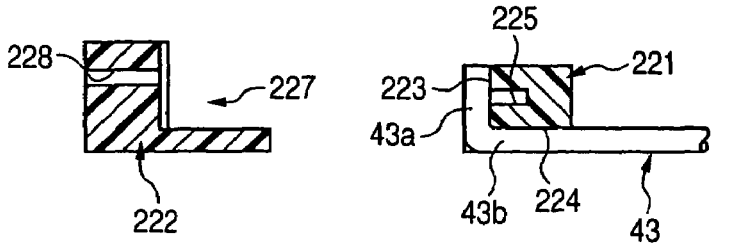

The press-contact assisting plate 222 is fittingly attached to the press-contacting blade-facing face of the wire holder 221. As shown in FIG. 26B, this plate 27 includes wire-holding portions 227 for respectively press-holding the end portions of the sheathed wires 43 each held in an L-shaped bent condition by the press-contacting portion-holding groove 223 and extending portion-holding groove 224 of the wire holder 25, and press-contacting blade guide portions 228 which respectively receive the distal ends of the press-contacting blades 241*a* when the wire holder 221 is fitted in the holder fitting portion 213, and also serve to guide the press-contacting blades 241*a* respectively to the press-contacting portions 43*a* of the sheathed wires 43. The wire holder 221 and the press-contact assisting plate 222 are held in a mutually-connected condition by interconnecting member including ribs and fitting grooves as described above for the interconnecting member 59.

In the press-contacting connector 201 of this fifth embodiment, the plurality of sheathed wires 43 are collectively press-contacted respectively with the press-contacting terminals 241 according to the following procedure. First, the end portions of the sheathed wires 43 are held in the respective press-contacting portion-holding grooves 223 and the respective extending portion-holding grooves 224 in such a manner that these end portions are bent in an L-shape, as shown in FIG. 26A. Then, the press-contact assisting plate 222 is fittingly attached to the press-contacting blade-facing face of the wire holder 221 as shown in FIG. 26B.

On the other hand, the press-contacting terminals 241, press-fastened respectively to the end portions of the joint-purpose wires 240 installed in a predetermined form, are beforehand inserted respectively in the terminal receiving holes 211 in the connector housing 210 as shown in FIG. 25.

Figure 28:
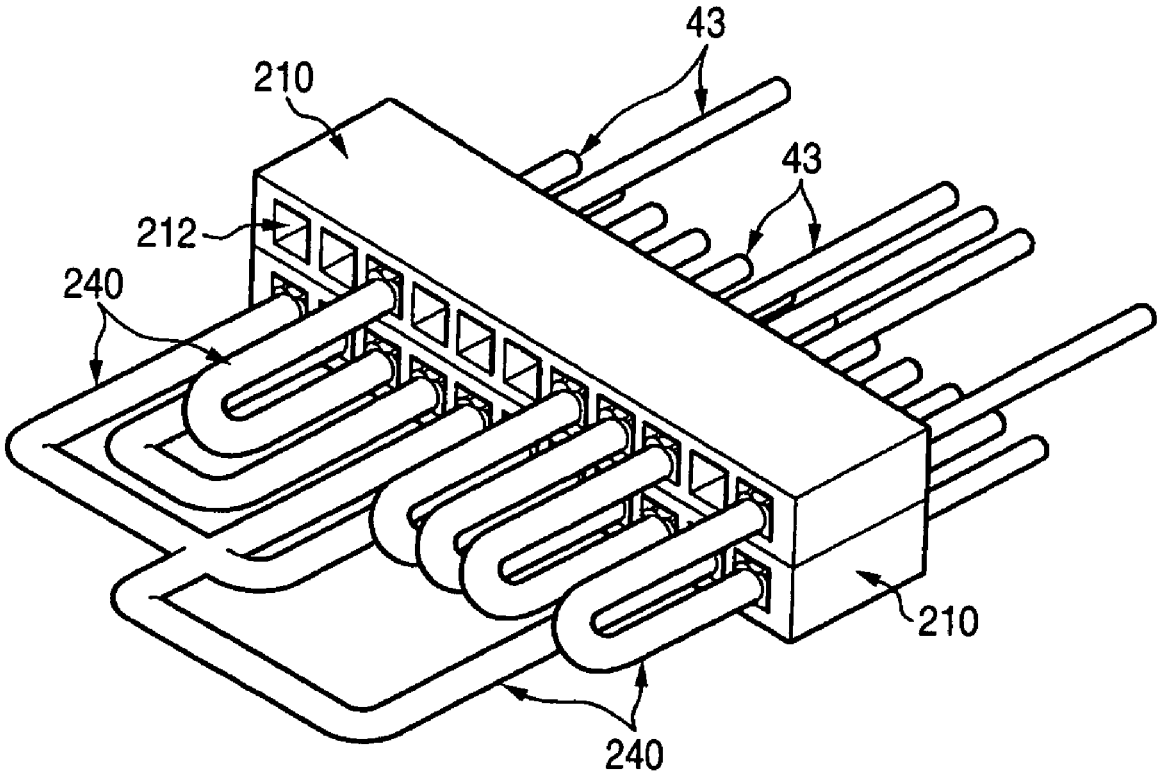
FIG. 28 is a perspective view showing a joint connector formed by combining the press-contacting connectors of FIG. 25 together.
Figure 29:
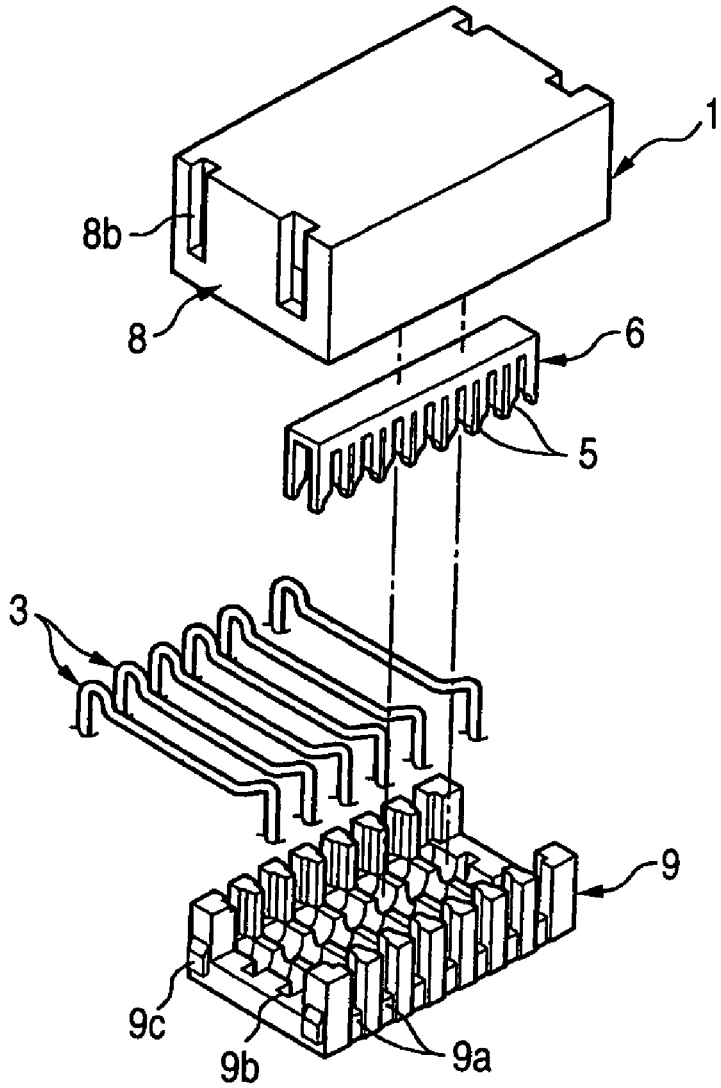
FIG. 29 is an exploded, perspective view of a related press-contacting connector.
Figure 30:
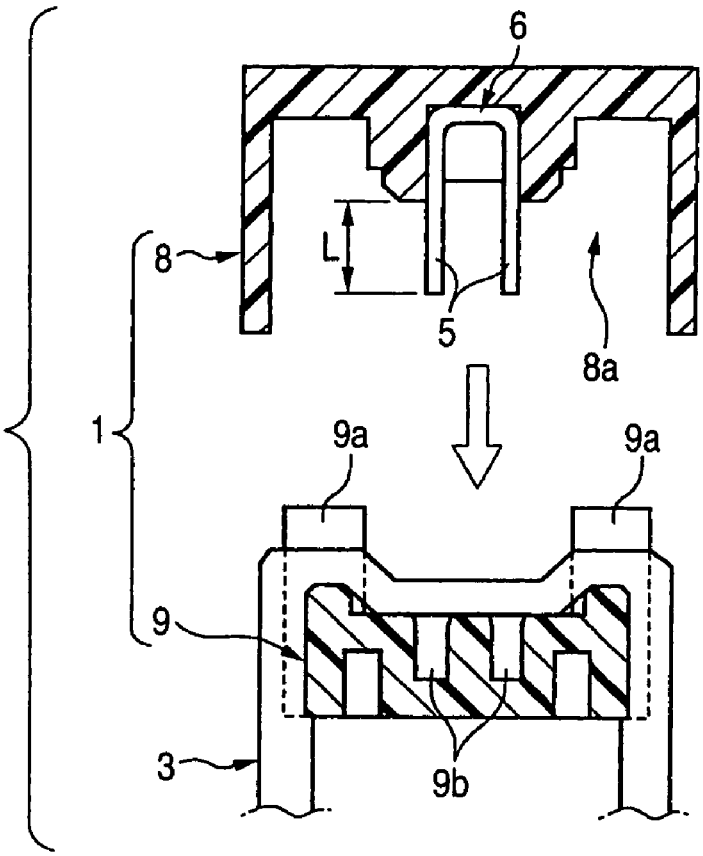
FIG. 30 is a cross-sectional view of the press-contacting connector of FIG. 29, showing a condition before a press-contacting operation is effected.
Figure 31:
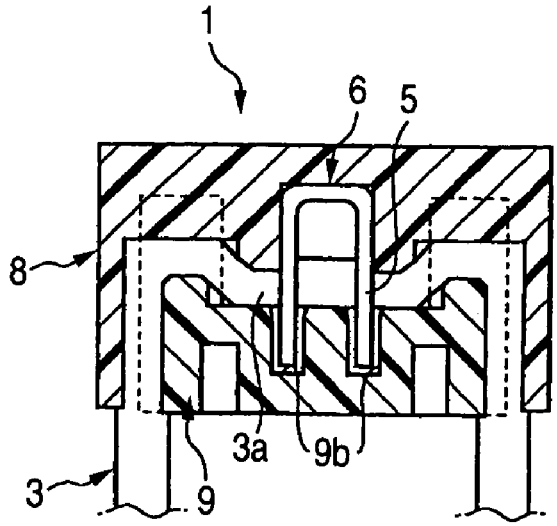
FIG. 31 is a cross-sectional view showing a condition in which a connector housing and a wire holder of FIG. 30 are fitted together.

The press-contacting connector 201 of this fifth embodiment is the joint connector, and a plurality of (two in this embodiment) connector housings 210 are combined together, and are integrally fixed together by fixing member (not shown) as shown in FIG. 28. Thereafter, the press-contacting terminals 241 of the joint-purpose wires 240 are suitably inserted respectively into predetermined ones of the terminal receiving holes 212, and by doing so, arbitrary complicated joint circuits can be formed.

Namely, by the use of the joint-purpose wires 240 each connected at its end to the press-contacting terminal 241, not only the joint between the adjacent terminal receiving holes 212 and 211 in the upward-downward direction or the right-left direction but also the joint between any two terminal receiving holes 212, disposed astride one or more stages (stacked connector housings) or disposed on an oblique line, can be achieved.

Figure 27A:
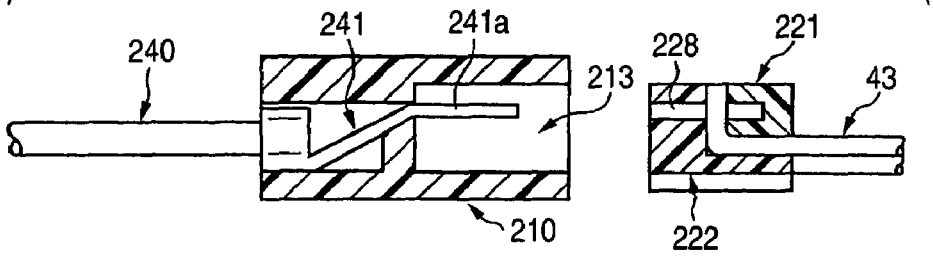
FIGS. 27A and 27B are vertical cross-sectional views explanatory of the procedure of mounting the wire holder of FIG. 25 on a connector housing.
Figure 27B:
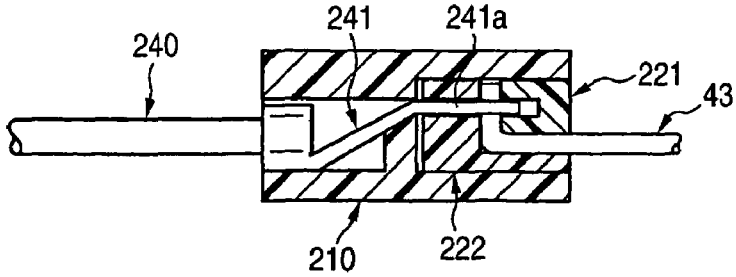

Then, each wire holder 221, cooperating with the press-contact assisting plate 222 to hold the press-contacting portions 43*a* of the sheathed wires 43 therebetween, is fitted into the holder fitting portion 213 of the corresponding connector housing 210 as shown also in FIG. 27.

At this time, first, the distal ends of the press-contacting blades 241*a* are received respectively in the press-contacting blade guide portions 228 of the press-contact assisting plate 222, and then a pressing operation is effected, and therefore the distal end of each press-contacting blade 241*a* is supported in a proper position by the press-contacting blade guide portion 228. Therefore, the deflection, buckling, etc., of the press-contacting blades 241*a*, inviting the incomplete press-contact, can be positively prevented, and the plurality of sheathed wires 43 can be collectively press-contacted respectively with the press-contacting terminals 241 in a stable manner.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A press-contacting connector, comprising:

a connector housing, including:

a plurality of press-contacting terminals; and a holder fitting portion, in which a plurality of press-contacting blades of the press-contacting terminals are provided;

a wire holder, fitted into the holder fitting portion of the connector housing, and holding a plurality of wires, said wire holder having a first side facing the connector housing and a second side opposing the connector housing, wherein a plurality of wire-end holding holes are formed in the first side of the wire holder which faces the connector housing and respective ends of the plurality of wires are inserted into the plurality of wire-end holding holes; and an assisting plate, attached to the first side of the wire holder so as to press press-contacting portions of the wires, and the assisting plate having a plurality of guide portions which guides the press-contacting blades to the press-contacting portions of the wires respectively, wherein when the wire holder is fitted into the connector housing, the press-contacting blades press-contact the press-contacting portions of the wires respectively.

2. The press-contacting connector as set forth in claim 1, wherein the wire holder holds the wires at a pitch corresponding to a pitch at which the press-contacting blades are arranged in the holder fitting portion.

3. The press-contacting connector as set forth in claim 1, wherein the guide portions receive distal ends of the press-contacting blades respectively, when the wire holder is provisionally fitted into the holder fitting portion; and wherein the guide portions guide the press-contacting blades respectively to the press-contacting portions of the wires when the wire holder is completely fitted into the holder fitting portion.

4. The press-contacting connector as set forth in claim 1, wherein the wire end-holding portions are holding grooves which are formed on a side face of the wire holder, and which communicate respectively with at least one end of the wire-holding grooves so as to hold extending portions of the wires.

5. The press-contacting connector as set forth in claim 1, further comprising a provisionally-retaining member which retains the wire holder to the holder fitting portion in a provisionally-fitted condition, wherein the provisionally-retaining member is provided between the connector housing and the wire holder.

6. The press-contacting connector as set forth in claim 1, wherein the wire holder includes a plurality of wire-holding grooves which respectively position the press-contacting portions of the wires in parallel and wire end-holding portions which are formed respectively at both ends of the wire-holding grooves; and wherein the wire end-holding portions hold the press-contacting portions of the wires respectively so as to bend at both ends of the press-contacting portions.

7. The press-contacting connector as set forth in claim 6, wherein the wire end-holding portions are wire end-holding hole which is formed respectively at least one end of the wire-holding grooves so as to hold end portions of the wires respectively.

* * * * *